US006169556B1

(12) United States Patent
Koitabashi et al.

(10) Patent No.: US 6,169,556 B1
(45) Date of Patent: Jan. 2, 2001

(54) METHOD FOR DRIVING A RECORDING HEAD HAVING A PLURALITY OF HEATERS ARRANGED IN EACH NOZZLE

(75) Inventors: Noribumi Koitabashi, Yokohama; Hitoshi Tsuboi, Tokyo, both of (JP)

(73) Assignee: Canon Kabushiki Kaisha, Tokyo (JP)

( * ) Notice: Under 35 U.S.C. 154(b), the term of this patent shall be extended for 0 days.

(21) Appl. No.: 08/884,465

(22) Filed: Jun. 27, 1997

(30) Foreign Application Priority Data

Jun. 28, 1996 (JP) ..... 8-170208
Jun. 28, 1996 (JP) ..... 8-170417

(51) Int. Cl.[7] ..... B41J 2/14
(52) U.S. Cl. ..... 347/48
(58) Field of Search ..... 347/48, 15, 107, 347/14

(56) References Cited

U.S. PATENT DOCUMENTS

| | | | | |
|---|---|---|---|---|
| 4,050,077 | * | 9/1977 | Yamada | 347/75 |
| 4,251,824 | * | 2/1981 | Hara | 347/57 |
| 4,353,079 | * | 10/1982 | Kawanabe | 347/15 |
| 4,380,771 | * | 4/1983 | Takatori | 347/63 X |
| 4,435,721 | * | 3/1984 | Tsuzuki | 347/48 |
| 4,847,358 | * | 7/1989 | Moriyama | 347/14 |
| 4,947,194 | * | 8/1990 | Kyoshima | 347/14 X |
| 4,965,594 | * | 10/1990 | Komuro | 347/62 |
| 5,172,139 | | 12/1992 | Sekiya et al. | 347/15 |
| 5,479,196 | | 12/1995 | Inada | 347/92 |
| 5,497,174 | | 3/1996 | Stephany et al. | 347/13 |
| 5,731,828 | * | 3/1998 | Ishinaga | 347/48 X |
| 5,754,201 | * | 5/1998 | Ishinaga | 347/62 |
| 5,790,152 | * | 8/1998 | Harrington | 347/48 |

FOREIGN PATENT DOCUMENTS

| | | | | |
|---|---|---|---|---|
| 0707964A2 | | 4/1995 | (EP) . | |
| 0694392A2 | | 1/1996 | (EP) . | |
| 0747221A2 | | 12/1996 | (EP) . | |
| 2169855A | | 7/1996 | (GR) . | |
| 55-132259 | | 10/1980 | (JP) . | |
| 59-204581 | * | 11/1984 | (JP) | B41J/13/00 |
| 62-035852 | | 2/1987 | (JP) . | |
| 62-261452 | | 11/1987 | (JP) . | |
| 1-235652 | | 9/1989 | (JP) . | |
| 1-237152 | * | 9/1989 | (JP) | B41J 3/04 |
| 1-290440 | * | 11/1989 | (JP) | B41J 3/04 |
| 3-61545 | * | 3/1991 | (JP) | B41J 2/175 |

* cited by examiner

*Primary Examiner*—Sandra Brase
(74) *Attorney, Agent, or Firm*—Fitzpatrick, Cella, Harper & Scinto

(57) ABSTRACT

An ink jet recording apparatus is disclosed. A recording head is provided with a plurality of heaters in each nozzle. The plurality of heaters are arranged with different distances OH from the position of a center of gravity to an orifice. A front heater and a rear heater are alternately driven to discharge ink.

59 Claims, 16 Drawing Sheets

| | | | | | | | |
|---|---|---|---|---|---|---|---|
| 1 | | F + B | F + B | B | F | | F |
| 2 | | F | F + B | F + B | B | | F |
| 3 | | F | B | F + B | B | F | B |
| 4 | | | F | F + B | F + B | B | |
| 5 | | | | F | B | F | |
| 6 | | F + B | B | F + B | B | F + B | B |

METHOD FOR DRIVING A RECORDING HEAD HAVING A PLURALITY OF HEATERS ARRANGED IN EACH NOZZLE

BACKGROUND OF THE INVENTION

1. Field of the Invention

The present invention relates to an ink discharging method using an ink jet head for discharging ink toward a medium (sheet, cap, etc.) by an input of an electrical signal, and an ink jet recording apparatus for implementing the ink discharging method and an ink jet recording head to be mounted on the apparatus. More particularly, the present invention relates to the drive of a recording head having a plurality of heaters arranged in each nozzle.

2. Related Background Art

Most of the ink jet recording apparatus have been known as printing apparatus in such equipments as printers, facsimile machines, word processors and copying machines. Among others, the ink jet recording apparatus of a system using thermal energy as energy to be utilized for the ink discharge, that is, a system which generates bubbles in ink by the thermal energy and discharges the ink by using a pressure in generating the bubbles has recently been widely used.

As another application of the ink jet recording apparatus of this system, an ink jet dying apparatus which prints a predetermined pattern or picture or a synthesized image on cloth has recently been developed.

The ink jet recording head used in the above ink jet recording apparatus uses electro-thermal transducer elements (hereinafter also referred to as heaters) to generate the thermal energy. The heaters are normally arranged in an ink flow path (hereinafter also referred to as a nozzle) connected to an orifice. In many cases, such an ink jet recording head adopts an arrangement of providing one heater for one nozzle.

In such an ink jet recording head, a distance from a center of gravity of the heater to the orifice (hereinafter referred to as OH) is a significant factor which influences a discharge characteristic of the ink jet recording head such as a discharge rate of ink droplets and a refill frequency. Specifically, it has been known that for the discharge rate of the ink droplets, the discharge rate is higher as the OH is shorter, and for the refill frequency, the frequency is lower as the OH is shorter. It is thus apparent that in the prior art ink jet recording head structure, the discharge rate of the ink droplets and the refill frequency are involved in trade-off for the OH, and in the prior art, the OH is determined in a range in which both the discharge rate of the ink droplets and the refill frequency are at practical levels.

In the field of the ink jet, further improvement of the image quality has recently been demanded. As one of means for printing an image of high resolution, the construction to form the image by small ink droplets of 25 pl or less. In order to discharge the small ink droplets by the above ink jet recording head, the thermal energy generated by the heater is normally reduced. As a result, the discharge rate of the small ink droplets tends to be reduced. The reduction of the discharge rate leads to the deterioration of the precision of impact points of the small ink droplets, and it particularly leads to the deterioration of the image quality in the image of high resolution. Accordingly, in such a case, it is desirable to set the OH lower in the ink jet recording head in order to prevent the reduction of the discharge rate.

However, in the above method, the print dots must be increased because the one-dot area displayed by the small ink droplet is reduced, and a higher print speed than that in the prior art, particularly the improvement of the refill frequency is required. As described above, since the refill frequency is lowered as the OH is reduced, the print speed is lower than that of the prior art when the above method is used.

Further, a problem may be raised in the predischarge which is conducted as a part of the discharge recovery process. In the predischarge, the ink which does not serve to the recording is discharged from the ink jet recording head at a predetermined position in the apparatus. In this manner, the high viscosity ink in the ink jet recording head is removed to keep good ink discharge condition. Such predischarge is normally conducted immediately after the power-on of the apparatus and periodically during the printing. When the printing is conducted by the small ink droplets or in the low temperature/low humidity environment, it is necessary to reduce the interval between predischarges. Because the discharge power by the small ink droplets is low and the high viscosity ink may not be stably discharged depending on the condition of the viscosity of the ink due to the evaporation of water at the orifice.

Since the predischarge is conducted at the predetermined non-print unit, it takes a long time. Accordingly, even if the discharge frequency is raised, the substantial print time may be long. Further, the consumption of the ink by the frequently conducted predischarge is not negligible.

FIG. 8 shows a relation between the distance OH and the predischarge interval IPE together with the discharge characteristic described above. When the distance OH is short, the predischarge interval may be remarkably long. Thus, the pre-discharge interval and the refill frequency fr of the ink are of conflict relation.

On the other hand, an apparatus having a plurality of heaters for each orifice from the viewpoint described below has been known. It uses a plurality of heaters for the purpose of increasing a range in which the ink discharge amount is changed. In this case, the discharge amount is changed by selecting the heaters to be driven (that is, the heaters to generate heat) and the number thereof.

In a specific construction, a plurality of heaters are arranged along the direction of ink discharge in the liquid flow path connected to the orifice of the ink jet head, and the distance between the orifice and the center of the driven heater is changed by selecting the driven heaters and the number thereof so that the discharge amount is changed.

In another construction, a plurality of heaters having different surface areas from each other are arranged in the liquid flow path, and the driven heaters or the number thereof is changed to change the ink discharge amount.

However, several problems are involved in implementing the ink jet recording apparatus having variable discharge amount.

In one problem, when the ink of small discharge amount is discharged, bubbles are generated by heaters having a small discharge power, that is, having a small heater area. As a result, not only the discharge amount but also the discharge rate are reduced. As an important matter, a problem may occur in connection with the predischarge which is conducted as a part of the discharge recovery process. In the predischarge, the ink which does not serve to the printing is discharged from the ink jet head at a predetermined position in the apparatus. Thus, the high viscosity ink in the ink jet head is removed and a good ink discharge condition may be maintained. The predischarge is normally conducted immediately after the power-on of the apparatus and periodically during the printing.

However, when the printing is made at the small discharge amount getting, it is necessary to shorten the predischarge interval. If the interval is too long, the high viscosity ink may not be stably discharged depending on the condition of the viscosity of the ink due to the evaporation of the water at the orifice because the power of the small discharge ink droplets is low. As a result, it is necessary to shorten the predischarge interval periodically conducted during the printing and the throughput of the printing is lowered.

As another problem, when the printing is made at the small discharge amount setting, the resolution is raised, the amount of image data is increased and the print dots are increased so that the print speed cannot be increased unless the discharge repetition frequency is raised.

The problems described above significantly depending on the type of ink.

SUMMARY OF THE INVENTION

It is an object of the present invention to significantly improve the refill frequency over the prior art by reducing the discharge rate of the ink droplets in the ink jet recording head.

It is another object of the present invention to provide an ink jet recording head and an ink jet recording apparatus which allow the discharge (recording) with variable discharge amount with a relatively simple construction and at an optimum discharge condition for the purpose of the head usage and the head use condition.

In order to achieve the above objects, according to the present invention, there is provided an ink discharge method comprising the steps of:

preparing an ink jet recording head comprising an orifice for discharging ink, an ink flow path connected to the orifice and a plurality of electro-thermal transducer elements arranged in the ink flow path for generating thermal energy, the recording head discharging the ink by applying the thermal energy to the ink in the ink flow path by driving the electro-thermal transducer elements, the electro-thermal transducer elements including two electro-thermal transducer elements having different distance between a center of gravity of the electro-thermal transducer element and the orifice; and discharging the ink by alternately driving the two electro-thermal transducer elements.

In accordance with the present invention, there is further provided an ink jet recording apparatus comprising:

an ink jet recording head comprising an orifice for discharging ink, an ink flow path connected to the orifice and a plurality of electro-thermal transducer elements arranged in the ink flow path for generating thermal energy, the recording head discharging the ink by applying the thermal energy to the ink in the ink flow path by driving the electro-thermal transducer elements, the electro-thermal transducer elements including two electro-thermal transducer elements having different distances between a center of gravity of the electro-thermal transducer element and the orifice; and drive control means for alternately driving the two electro-thermal transducer elements.

In accordance with the present invention, there is further provided an ink jet recording head comprising an orifice for discharging ink, an ink flow path connected to the orifice and a plurality of electro-thermal transducer elements arranged in the ink flow path for generating thermal energy, the recording head discharging the ink by applying the thermal energy to the ink in the ink flow path by driving the electro-thermal transducer elements, the plurality of electro-thermal transducer elements including two electro-thermal transducer elements having different distances between a center of gravity of the electro-thermal transducer element and the orifice, the two electro-thermal transducer elements being alternately driven.

In accordance with the present invention, there is further provided an ink jet recording head comprising:

a plurality of electro-thermal transducer elements arranged in an ink flow path connected to an orifice of ink, two of the electro-thermal transducer elements being arranged with different distances from the orifice to the electro-thermal transducer element, the two electro-thermal transducer elements having the substantially same discharge amount of droplets when driven independently; and means for switching the electro-thermal transducer element to be driven in accordance with various information.

In accordance with the present invention, there is further provided a recording head having a plurality of electro-thermal transducer elements arranged in an ink flow path connected to an orifice of ink, two of the electro-thermal transducer elements being arranged with different distances from the orifice to the electro-thermal transducer element, the two electro-thermal transducer elements having the substantially same discharge amount of droplets when driven independently; and means for switching the electro-thermal transducer element to be driven in accordance with various information.

In accordance with the present invention, there is further provided an ink jet recording method comprising the steps of:

preparing a recording head having a plurality of electro-thermal transducer elements arranged in an ink flow path connected to an orifice of ink, two of the electro-thermal transducer elements being arranged with different distances from the orifice to the electro-thermal transducer element, the two electro-thermal transducer elements having the substantially same discharge amount of droplets when driven independently; and switching the electro-thermal transducer element to be driven in accordance with various information.

As described above, the present invention fully utilizes the discharge characteristic in which, by switching the electro-thermal transducer element to be driven, the discharge rate increases as the position of the electro-thermal transducer element is closer to the orifice and the refill frequency, contrary to the discharge rate, decreases as the position of the electro-thermal transducer element is closer to the orifice.

DESCRIPTION OF THE PREFERRED EMBODIMENTS

The present invention has been made from the novel features resulted from the discussion of the practical use as the recording apparatus in the head structure to be described hereinlater.

Figure 1:
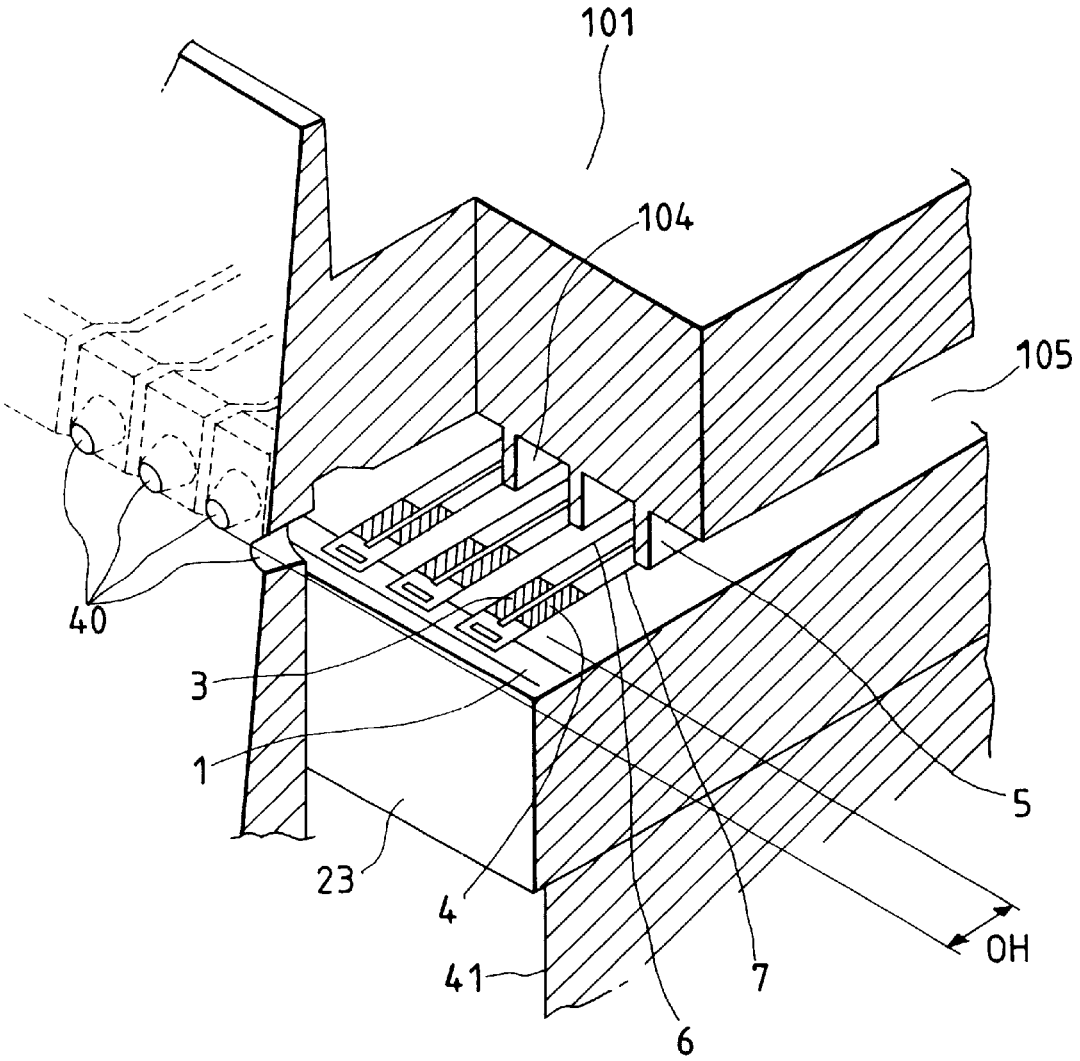
FIG. 1 shows a perspective view of a construction of an ink jet recording head of the present invention.
Figure 2:
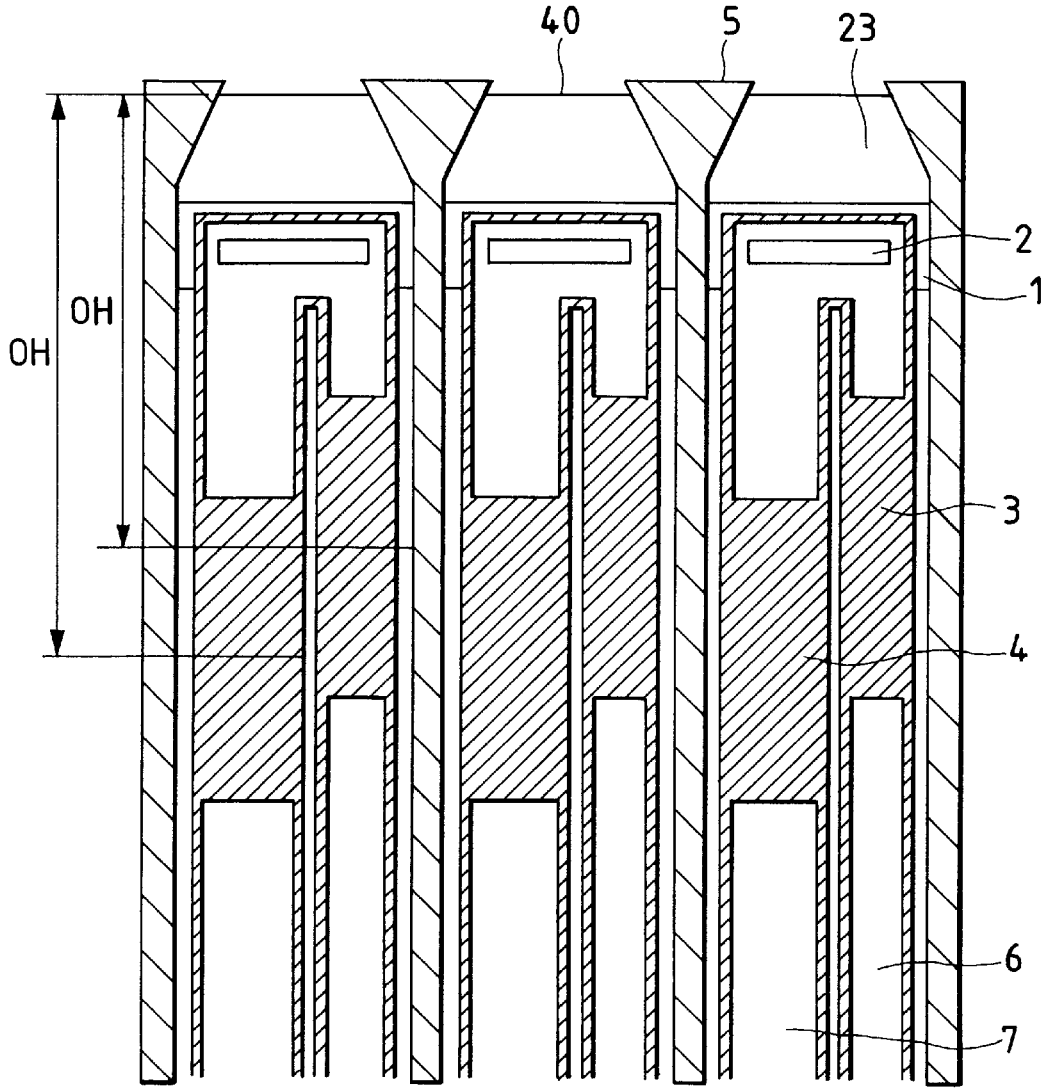
FIG. 2 shows an arrangement of heaters on an element board shown in FIG. 1.

Referring first to FIGS. 1 and 2, a construction of the ink jet recording head of the present invention is explained.

FIG. 1 shows a perspective view of the ink jet recording head. The recording head is of a type called an edge shooter type and a nozzle arrangement density is 360 DPI.

As shown in FIG. 1, an element board 23 having a plurality of heaters which are electro-thermal transducer elements arranged is arranged on a support 41 formed by a metal such as aluminum.

Orifices 40 which are discharge ports for discharging ink and nozzle walls 5 are provided on a top plate 101. As shown, the element board 23 and the top plate 101 are joined to form nozzles 104 and ink chambers 105.

FIG. 2 shows a diagram of an arrangement of the heaters on the element board of the ink jet recording head. In each nozzle 104 between nozzle walls 5, two heaters, a front heater 3 and a rear heater 4 are arranged partially side by side and with different distances OH from a center of gravity of the heater to the discharge port (orifice).

The respective heaters 3 and 4 are connected to a common wiring 1 under interlayer insulation films of under layers of the heaters 3 and 4 through through-holes 2 and a voltage is applied by the common wiring 1. Wirings 6 and 7 are connected to the front heater 3 and the rear heater 4, respectively.

Inks are supplied from the ink chambers 105 to the nozzles 104, the heaters 3 and 4 provided in the nozzles 104 are driven by signal currents to heat the inks in the nozzles to cause the generation of air bubbles, and the inks in the nozzles are discharged toward a recording medium by the generation of the air bubbles.

In the present embodiment, the two heaters 3 and 4 of substantially same size and same length are arranged in the nozzle 104 and the discharge amounts of the small droplets when the two heaters are independently driven, are substantially same approximately 20 pl.

Figure 3:
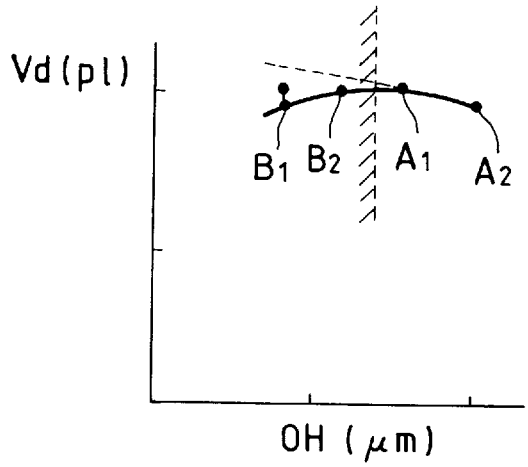
FIG. 3 shows a graph of as relation between a distance OH from an orifice to a heater and a discharge amount Vd of the discharge characteristics of the ink jet recording head of the present invention.
Figure 4:
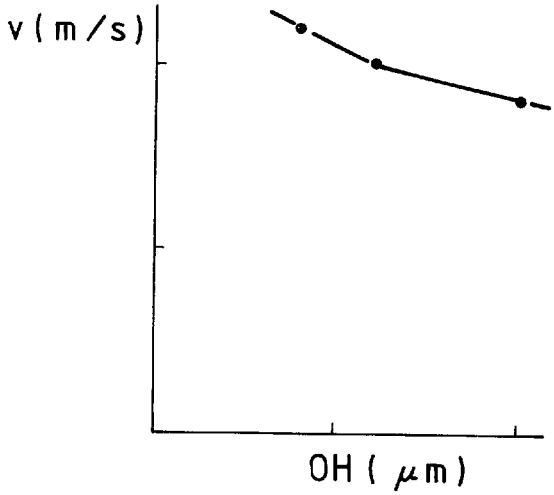
FIG. 4 shows a graph of a relation between the distance OH from the orifice to the heater and a discharge rate v of the discharge characteristics of the ink jet recording head of the present invention.
Figure 5:
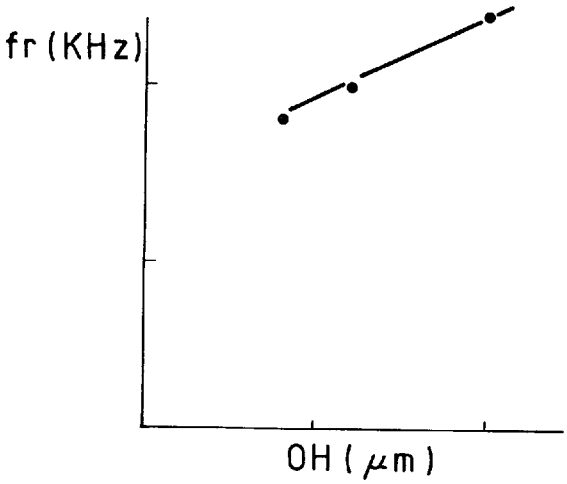
FIG. 5 shows a relation between a refill frequency fr and the distance OH of the discharge characteristics of the recording head.

Referring to FIGS. 3 to 5, the discharge characteristics of the small droplets of the ink jet recording head are explained.

The distance OH between the center of gravity of the heater and the discharge port (orifice) is a significant factor to influence to the discharge characteristics. When the distance OH is used as a parameter, it has been proven by the study that the discharge amount Vd (pl) of the droplets, the discharge rate v (m/s) and the refill frequency fr (Khz) exhibit the following characteristics.

Namely, when the sizes of the front and rear heaters are identical, the refill frequency fr is significantly improved when the rear heater 4 which is farther from the orifice (longer OH) is driven as shown in FIG. 5. Namely, the refill frequency fr is higher because a return time of a meniscus is faster. Accordingly, when the rear heater 4 alone is driven, high speed printing is attained. However, the discharge rate v is low as shown in FIG. 4. In other words, when the front heater 3 which is closer to the orifice (shorter OH) alone is driven, the discharge rate v is significantly improved, but, on the other hand, the refill frequency fr is low as shown in FIG. 5. In this manner, it has been proved that the discharge rate v and the refill frequency fr are of conflict relation. In this case, when the distance OH is in the range shown in FIG. 3, the discharge amount Vd is substantially constant for the distance OH and any OH may be selected.

Further, by setting the distances OH to B2 and A2 shown in FIG. 3 and making the size of the rear heater 4 slightly larger than the size of the front heater 3 (preferably the same length with the width being slightly wider), the discharge amounts when the respective heaters are independently driven may be made substantially equal. Alternatively, the distances OH may be set to B1 and A1 shown in FIG. 3 and the size of the front heater 3 may be made larger than the size of the rear heater 4. In this case, it has been proved that the discharge characteristics described above do not basically change.

Figure 6:
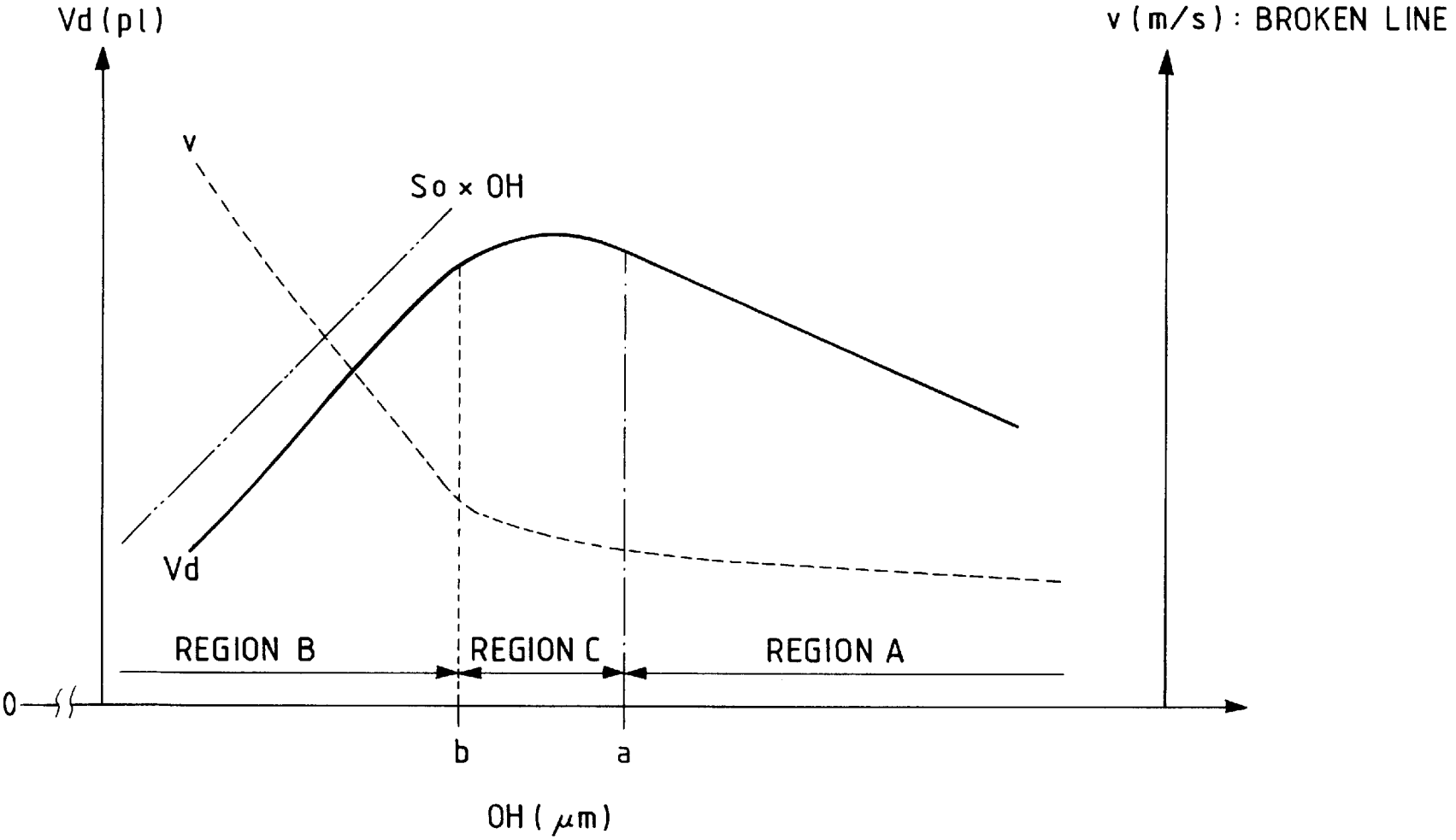
FIG. 6 shows a relation among the droplet discharge amount Vd, the discharge rate v and the distance OH.
Figure 7:
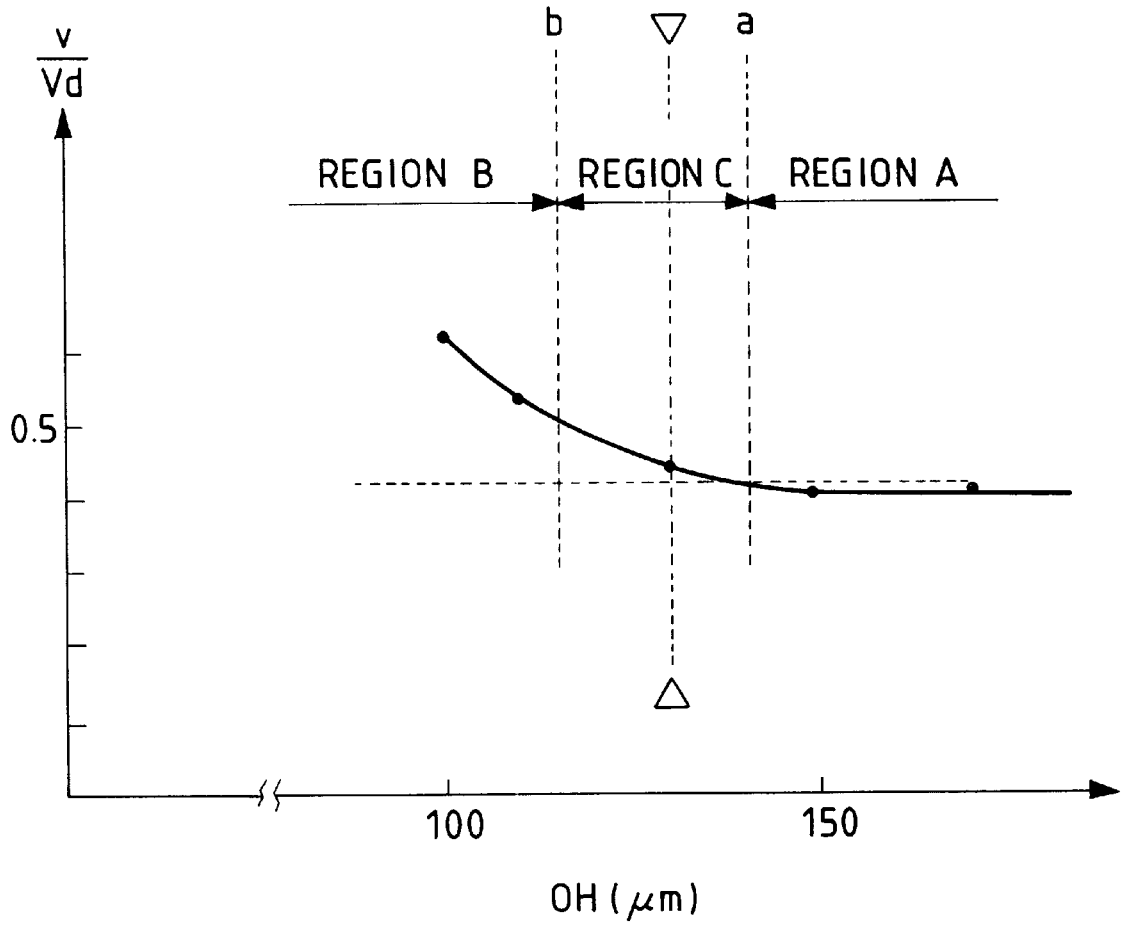
FIG. 7 shows a relation between a quotient of the discharge rate v divided by the discharge amount Vd and the distance OH.

FIG. 6 shows a chart of relations between the discharge amount Vd of the droplets and the discharge rate v, and between a product of a discharge port area So and the distance OH from the discharge port to the end of the heater and the distance OH, and FIG. 7 shows a relation between a quotient (v/Vd) of the discharge rate v divided by the discharge amount Vd and the distance OH. In FIGS. 6 and 7, peculiar points a and b are defined and the distance OH is divided into three areas, an area A not smaller than a, an area B not larger than b and an area C between a and b.

As a specific trend of each area, it is pointed out that, in the area A, the discharge rate v and the discharge amount Vd are substantially proportional, and v/Vd is substantially constant. It is also pointed out that, in the area B, the discharge amount Vd is substantially proportional to the product of the discharge area So and the distance OH, and in the area C, the discharge amount is substantially constant. The areas A to C may be defined as follows when they are viewed from the discharge amount Vd and the discharge rate v, respectively.

When Viewed From the Discharge Amount Vd

Area A: The discharge amount Vd decreases as the distance OH increases.

Area B: The discharge amount Vd increases substantially proportionally to the distance OH.

Area C: The discharge amount Vd is substantially constant for the distance OH.

When Viewed From the Discharge Rate

In all areas, the discharge rate v decreases as the distance OH increases and in the area C, the amount of change is gentle.

As shown in FIG. 6, the discharge amount Vd of the ink droplets exhibits a peak at a predetermined distance OH and decreases as it departs from the predetermined distance OH. The discharge amounts Vd of the rear heater 4 and the front heater 3 may be made substantially equal by arranging the rear heater 4 in the area A and the front heater 3 in the area B so that the distances OH of the respective heaters are symmetric about the distance OH which is a flection point.

A driving method for the ink jet recording head described above is now explained.

Embodiment 1

In the present embodiment, basically, the front heater 3 and the rear heater 4 are alternately driven such that the front heater 3 is first driven to discharge the ink droplets, then the rear heater 4 is driven to discharge the ink droplets, and then the front heater 3 is driven.

By driving the respective heaters in this manner, the refill frequency may be improved without lowering the discharge rate.

The behavior of the meniscus near the orifice and the discharge characteristics when the heaters are driven in this manner are explained below.

First, the front heater 3 is driven to discharge the ink droplets by the pressure of air bubbles of the ink generated on the heater surface. In this case, since the distance of the front heater 3 is closer to the orifice, the front flow resistance of the bubbles (in this case the inertance in front of the center of gravity of the heater) is small and the discharge rate v of the ink droplets is high. After the ink discharge, the air bubbles generated on the heater surface shrink and the meniscus at the orifice is pulled in. In this case, again, since the distance of the front heater 3 is closer to the orifice, the time required for the meniscus to return before the discharge is long. In other words, the refill frequency is low.

Assuming that the nozzle drive frequency is 12 kHz and when the ink is to be continuously discharged from the nozzle, the meniscus frequency fr is approximately 9 kHz at most and the meniscus may not fully return. When the same front heater 3 is driven without switching the heater to be driven under this condition, the ink amount in front of the heater reduces and the droplets with small discharge amount Vd are discharged. When the meniscus further retracts, the discharge power of the heater increases and the printing become blurred if the solid printing is conducted, and the image quality is lowered.

However, in the present invention, since the rear heater 4 is driven even if the meniscus does not fully return, the discharge amount and the discharge rate are substantially equal to those when the front heater is driven by the action to be described later.

When the rear heater 4 is driven to discharge the ink droplets while the meniscus is in a stable condition, the discharge amount Vd does not significantly change from that when the front heater 3 is driven as described above, but the reduction rate of the discharge rate v is large. However, when the rear heater 4 is driven to discharge the ink droplets while the meniscus is retracted, the discharge rate v is high by the effect that the distance between the meniscus and the heater is shorter. Since the flat portion of the meniscus to which the impact of the bubbles acts is narrow, the same effect as that of the reduction of the orifice diameter is attained and it is considered that this contributes to the increase of the discharge rate v. Further, since the distance to the orifice in front of the heater increases, the discharge amount Vd is not reduced and the stable discharge is attained.

After the discharge by the rear heater 4, the bubbles generated on the rear heater surface shrink and the meniscus of the orifice is pulled in. In this case, since the distance of the center of gravity of the rear heater 4 is far from the orifice, the amount of retraction of the meniscus is small and, as a result, the refill time, that is, the time required for the meniscus to return to the condition before the discharge is short. In other words, the refill frequency fr rises.

When the front heater 3 is driven to discharge the ink droplets in the subsequent timing, the meniscus has already returned to the predetermined position and the stable discharge is attained even if the discharge is continuously repeated. Since the discharge rate v is raised, the predischarge interval may be set longer.

Embodiment 2

The first embodiment relates to the continuous discharge of the small ink droplets. In the present embodiment, the front and rear heaters of the ink jet recording head of the Embodiment 1 are simultaneously driven to attain the discharge of the ink droplets at approximately double amount or approximately 40 pl to attain half tone presentation.

The present embodiment illustrates the half tone presentation by the ink jet recording head of the present invention.

The ink jet recording head of the present embodiment has two modes, a large ink droplet discharge mode for discharging large ink droplets and a small ink droplet discharge mode for discharging small ink droplets.

A drive method when the printing is made with the large dot mode printing for discharging the large ink droplets and the small dot mode printing for discharging the small ink droplets mixed, is explained below.

Figures 9A, 9B:
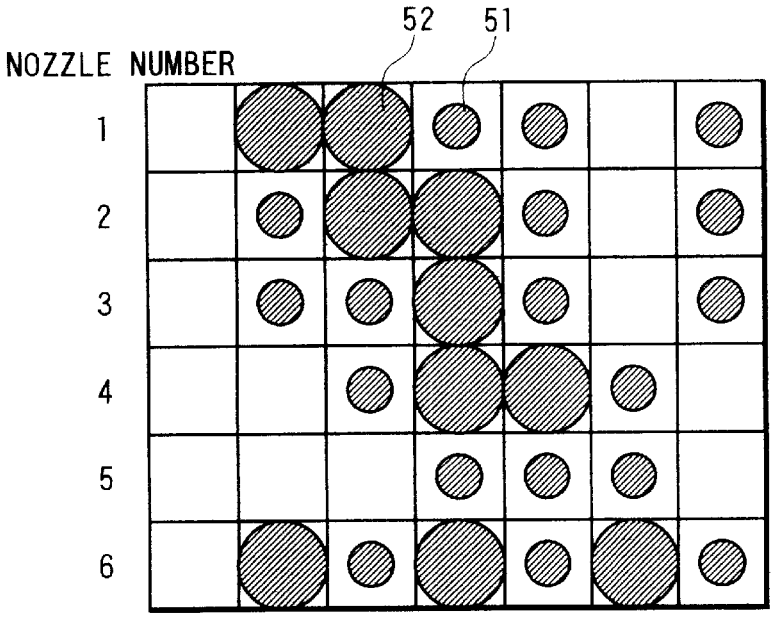
FIGS. 9A and 9B show data processings when the printing is made with large dots and small dots mixed.

FIGS. 9A and 9B show data processings when the printing is made with the large dots and the small dots mixed. FIG. 9A discharge data and FIG. 9B shows the heater driven by the image data of FIG. 9A.

In FIGS. 9A and 9B, F represents the drive of only the front heater, B represents the drive of only the rear heater and F+B represents the drive of the front and rear heaters. The small dots are represented by small dots 51 and the large dots are represented by large dots 52. FIGS. 9A and 9B show the manner in which the ink droplets are discharged from left to right in the drawings.

The heater to be driven (F, B or F+B) is determined for each nozzle by the data processing and the basic matters of the manner of determination are described below.

(1) For the small dot data next to the non-data pixel in one nozzle for one line of discharge data (not necessarily the image data), the small ink droplets are discharged by the front heater (F) as they are in the Embodiment 1. By doing so, an excellent discharge rate is attained.

(2) For the small dot to be printed following to the small dot, B is used if it follows F, and F is used if it follows B. By doing so, in the former case, both the refill frequency fr and the discharge rate v are good as described in the Embodiment 1.

(3) For the small dot to be printed immediately after the large dot. B is used (F+B→B). By doing so, the refill frequency fr is high and the discharge rate v is high.

Namely, since the return time of the meniscus is long immediately after the discharge of the large dot (F+B) and the small dot(F), when the small dot is to be printed, the discharge is made by B so that the refill frequency is high.

In accordance with the present invention, the excellent discharge rate and refill frequency are secured even when the half tone presentation is conducted, and the half tone presentation of high grade is attained.

In the present invention, as to the drive of the respective heaters, the heater to be driven may be driven by drive control means of the ink jet recording apparatus or drive switching means may be provided in the ink jet recording head.

In accordance with the present invention, even when small ink droplets are to be discharged, the refill frequency may be significantly improved without lowering the discharge rate of the ink droplets and the predischarge interval may also be increased.

Third Embodiment

Figure 10:
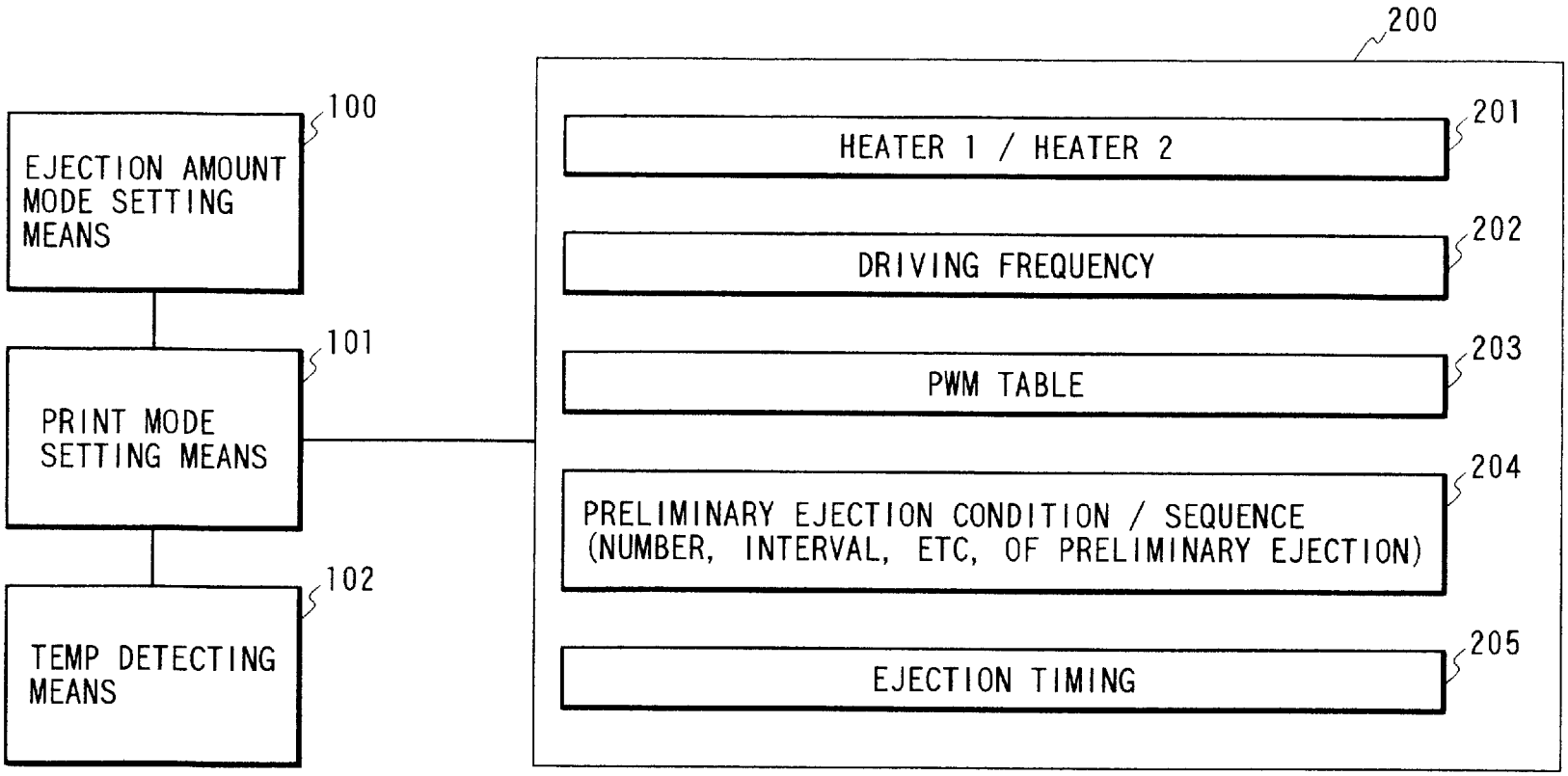
FIG. 10 shows a block diagram of a first embodiment of the ink jet recording head of the present invention.

FIG. 10 shows a block diagram of a third embodiment of the ink jet recording apparatus of the present invention.

In the present embodiment, the heater to be driven is switched in accordance with temperature environment information of a main unit. The apparatus comprises discharge amount setting means 100, print mode setting means 101 and detection means (temperature sensor) 102 for the temperature in the main unit, and it follows a selected desired mode and control means 200 switches the heater to be driven in accordance with the temperature in the main unit and the discharge is made at the condition appropriate to the switched heaters. The control means 200 comprises means 201 for controlling the switching of the heaters, means 202 for controlling the drive frequency, a table 203 for modulating a pulse width, means 204 for controlling the predischarge condition and means 205 for controlling the discharge timing.

The discharge amount control is first explained. The discharge amount mode basically includes two modes, a small discharge amount mode and a large discharge amount mode. The main heater to driven is switched in accordance with the discharge amount mode. The small discharge amount mode comprises a first small discharge amount mode for driving only the rear heater and a second small discharge amount mode for driving only the front heater to discharge the same amount of ink droplets as that in the first small amount mode. The large discharge amount mode drives both the front heater and the rear heater.

The print mode is now explained. The print mode may comprise a basis density print mode at 360 dpi, a high density print mode at 720 dpi, a smoothing mode for smoothing the outline of the printing and a multi-value record mode.

In the basic density print mode, the printing at 360 dpi is made in the large discharge amount mode by using all nozzles. In the high density print mode, the printing at 720×720 dpi is made by the interlace printing in the sub-scan direction, that is, the printing for filling the space between print dots in the feed direction of the recording medium transverse to the scan direction of the head, basically in the small discharge amount mode by using all nozzles. In the smoothing mode, the roughness of the outline of the printing is smoothened by using the smaller discharge amount (small discharge amount mode) than that in the basic density print mode at 360 dpi for the outline of the printing by the basic density print mode. In the multi-value recording mode, the large dot by the large discharge amount mode and the small dot by the small discharge amount mode are switched for each pixel. In this case, the three-value (non-dot, large dot, small dot) half tone presentation may be effectively attained for each pixel by using a spread-free sheet.

The operation when the desired mode is selected is specifically explained.

Figure 11A:
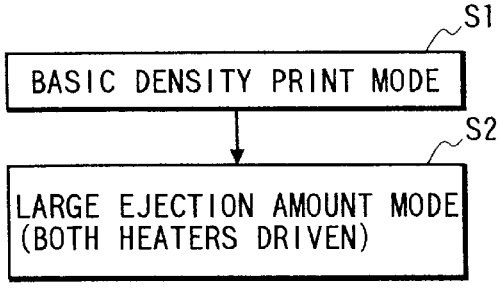
FIGS. 11A and 11B show flow charts when a basic density mode is selected as a print mode and a high density mode is selected in a third embodiment of the present invention.

(1) When the basic density print mode is selected, both of the two heaters are driven in the large discharge amount mode (see FIG. 11A, S1, S2) and the printing is made at the drive frequency of 6 KHz. The discharge amount is set to 70 pl for the black ink and 40 pl for the color ink.

Figure 11B:
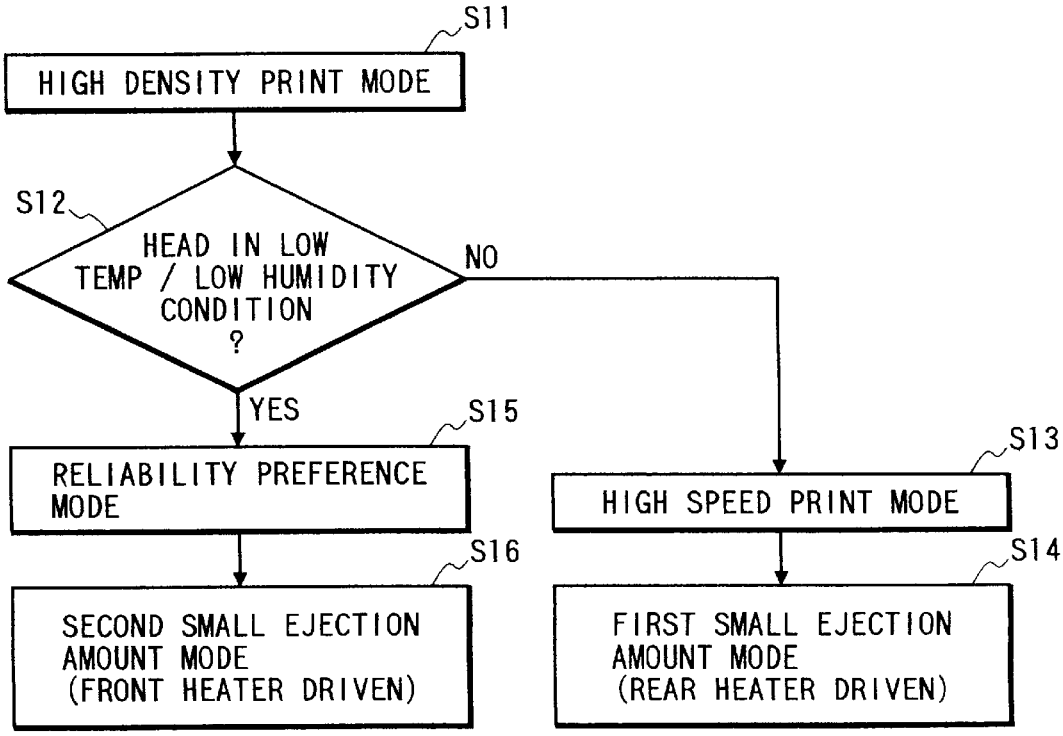

(2) When the high density print mode is selected, one of the first small discharge amount mode or the second small discharge amount mode is used (see FIG. 11B).

In the first small discharge amount mode, the high speed printing at the drive frequency of 12 KHz which is approximately double of the basic density printing may be attained by using the rear heater. This operation mode is called a "high speed print mode". The discharge amount in this mode is set to 35 pl for the black ink and 20 pl for the color ink. The head scan speed is same as that of the basic density print mode at 360 dpi.

In the second small discharge amount mode, the printing is made at the drive frequency of 8 KHz which is slightly lower than that of the high speed print mode by driving the front heater, and the printing of higher discharge rate, that is, higher discharge power than those of the high speed print mode is attained. This operation mode is called a "discharge reliability priority mode". The discharge amount in this mode is same as that in the first small discharge amount mode and set to 35 pl for the black ink and 20 pl for the color ink. The head scan speed is set to ⅔ of that in the high speed print mode.

The switching of the "high speed print mode" and the "discharge reliability priority mode" in the high density print mode is conducted by the temperature environment of the head monitored by the detection means (temperature sensor) (see FIG. 11B, S11 to S16).

Namely, when the head is in the normal environment, the printing is made in the "high speed print mode". However, since the rear heater is driven in the high speed print mode, it is necessary to set the predischarge interval to be substantially short when the head is in the low temperature/low humidity environment by the affect of the increase of the viscosity of the ink as seen from the graph shown in FIG. 8. The predischarge takes a long time because it is made in the predetermined non-print unit. Accordingly, even if the discharge drive frequency is raised in the high speed print mode, the substantial print time is long because the predischarge interval must be set substantially short. Further, when the predischarge is frequently conducted, the consumption of the ink is large.

Thus, in the present embodiment, when the low temperature or low humidity environment of the head is detected by the temperature sensor such as a thermistor in the head main unit, the mode is switched to the "discharge reliability priority mode" to prevent the failure of the discharge due to the increase of the viscosity of the ink at the orifice so that the printing is made by the front heater having the higher discharge power.

Figure 8:
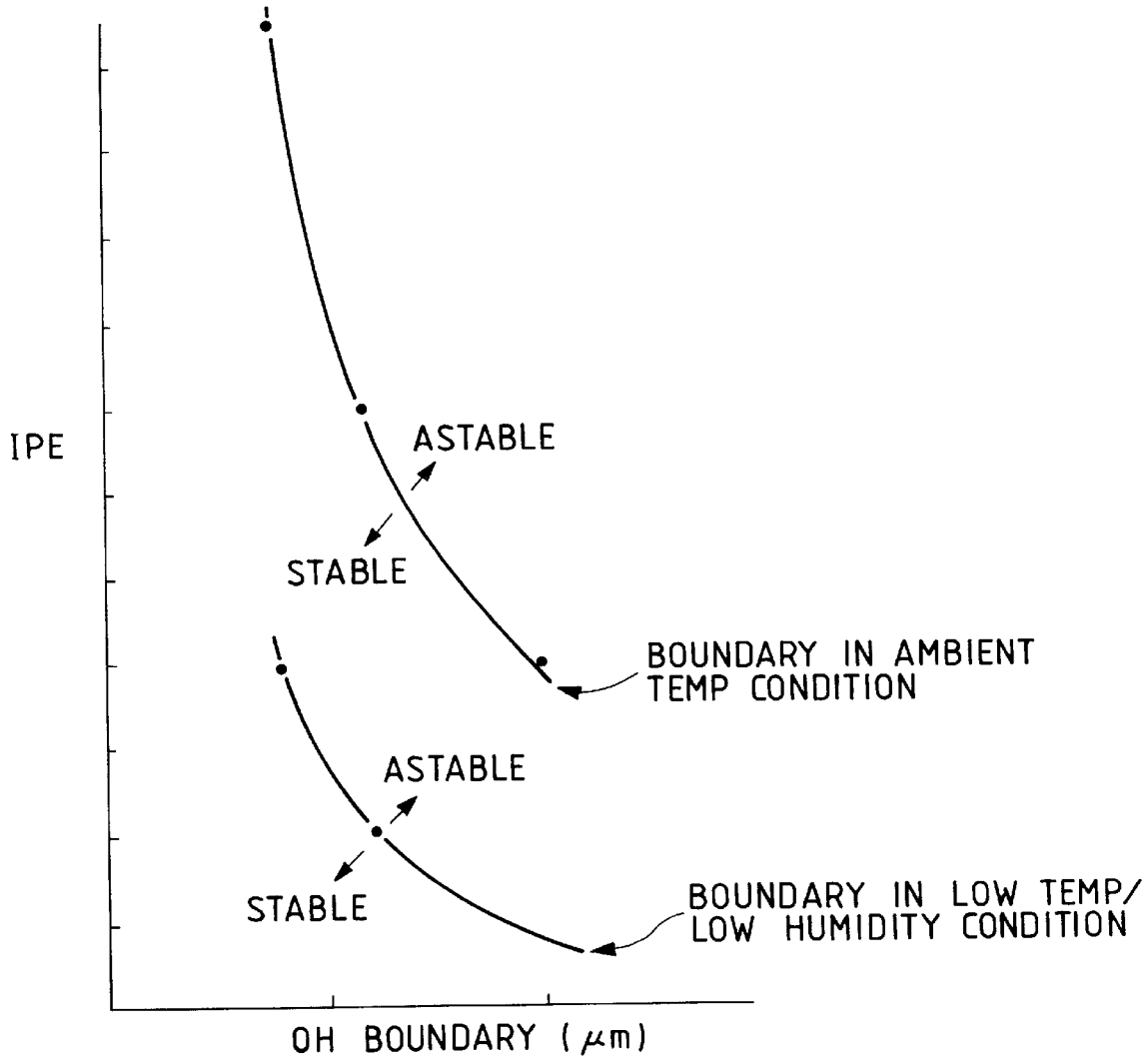
FIG. 8 shows a relation between a predischarge interval and the distance OH.

By the discharge reliability priority mode, the head discharge drive frequency is set to 8 KHz which is slightly lower than that in the high speed print mode and the predischarge interval is set long as seen from the graph of FIG. 8 so that the time required for the predischarge may be shortened. As a result, the substantial print speed is increased Further, the consumption of the ink is reduced.

(3) When the smoothing mode is selected, for the nozzle which discharges the small dots at smaller discharge amount than that in the basic density print mode for the outline of the dot printing by the basic density print mode, the high speed print mode (first small discharge amount mode) for driving only the rear heater is selected when the head main unit is in the normal temperature environment, and the discharge reliability priority mode (second small discharge amount mode) for driving only the front heater is selected when the head main unit is in the low temperature/low humidity environment.

(4) When the multi-value record mode is selected, for the nozzle which discharges the small dots, the high speed print mode for driving only the rear heater is selected when the head main unit is in the normal temperature environment, and the discharge rehability priority mode for driving only the front heater is selected when the head main unit is in the low temperature/low humidity environment.

When the discharge amount mode is switched for one mode as described above, the ink droplets of different discharge amounts are discharged from the same nozzle and the discharge rate changes between the large discharge amount mode and the small discharge amount mode. As a result, when the smoothing mode or the multi-value record mode is selected, the large dots and the small dots are mixedly discharged during the forward scan of the head and it may be considered that the precision of the impact point is deteriorated by the difference of the discharge rates of the large and small dots. In the present embodiment, the impact points of the large and small dots are aligned to the center position by changing the discharge timings of the ink droplets in accordance with the discharge amount mode.

Specifically, since the discharge rate is higher for the large discharge amount, the discharge timing of the large dot is delayed. Even for the small dot, when the front heater is driven (second small discharge amount mode), since the discharge rate of the small dot may be high and the difference from the discharge rate of the large dot is small, the discharge timing may not be changed. In this manner, even in the smoothing mode or the multi-value record mode in which the large and small dots are mixedly discharged during the formward scan of the head, a high precision image is attained by changing the discharge timing in accordance with the switching of the heater.

For the head structure in which the large dots and the small dots cannot be switched in a short time period during the forward scan of the head when the smoothing mode or the multi-value record mode is selected, a high precision image may be attained by discharging the large dots in the forward scan of the printing and the small dots in the backward scan.

For the heaters, the so-called pre-heat PWM control is usually conducted by double pulses to stabilize the discharge amount, but when the position of the heater in the nozzle changes, the characteristic of the discharge amount change by the pre-heat condition also changes. Thus, in the present embodiment, the PWW table is changed in accordance with the position of the heater to be driven to compensate and stabilize the difference of the discharge characteristic by the double pulses due to the position of the heater.

In the embodiment described above, the problem caused by the increase of the viscosity of the ink in the predischarge by the temperature environment of the head main unit when the smaller ink droplets than the discharge amount of the basic density printing is used is solved by selecting the discharge of the small dots by the front heater having the high discharge power (discharge rate) or the discharge of the small dots by the rear heater having the high discharge drive frequency in accordance with the temperature environment.

The recording apparatus such as the printer to which the present embodiment is applied may provide a good image in accordance with an environment of an area to which the recording apparatus is shipped and a season without determining a specification of the head before the shipment in accordance with the environments of various areas in the world. In this case, the print mode may be switched on the panel of the apparatus or the screen of the personal computer in accordance with the environment and the season.

In the present embodiment, the positions of the heater to be driven is switched in accordance with the temperature environment of the head main unit. In the present invention, in order to provide a novel ink jet recording apparatus in which when the precision of the impact point and the discharge reliability are more important even though the print speed is somewhat slow, the front heater which conducts the discharge with the high discharge power (discharge rate) is selected, and when the high print speed is more important even though the precision of the impact point and the discharge reliability are somewhat lower, the rear heater which provides the high discharge drive frequency is selected, the positions of the heater to be driven may be switched in accordance with the application of the head irrespective of the head temperature information.

Fourth Embodiment

Figure 12:
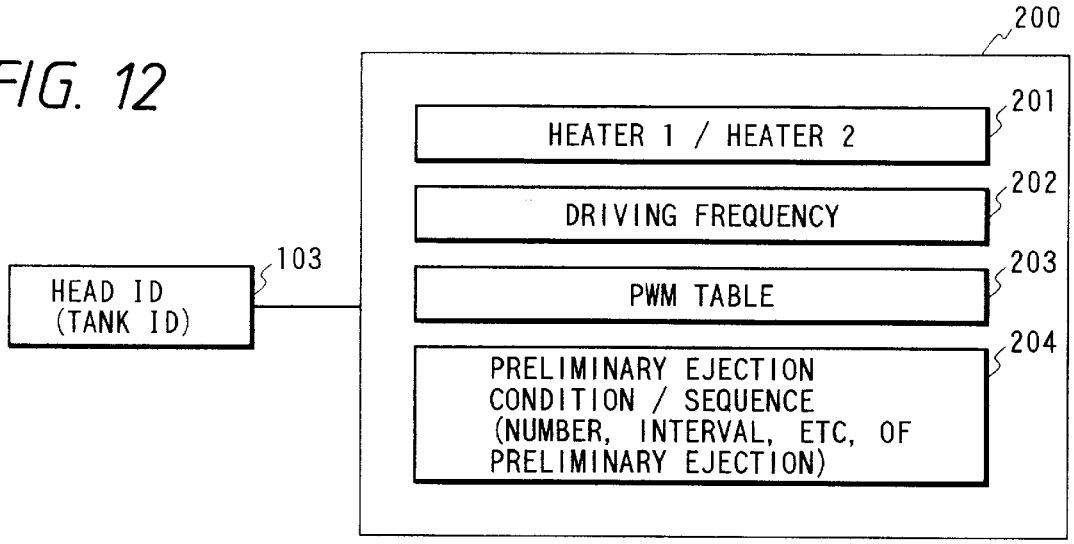
FIG. 12 shows a block diagram of a fourth embodiment of the present invention.

FIG. 12 shows a block diagram of the fourth embodiment of the ink jet recording apparatus of the present invention. The like elements to those of FIG. 10 are designated by the like numerals.

In the present embodiment, when the printing is made by the small dots, the heater to be driven is switched by the ink type information used for the head. Namely, the ink which is more easily dried than the normal ink may be used as an option. When such an ink is used, since the discharge power (discharge rate) is low by the small discharge amount setting by the rear heater as seen from the graph shown in FIG. 4, it is necessary to shorten the predischarge interval than that of the normal ink depending on the degree of increase of the viscosity of the ink at the orifice. In the present embodiment, when the special ink is used, the drive is switched to the front heater which provides the high discharge power (discharge rate).

In this case, an ID (identification means) 103 for identifying which one of the front and rear heaters is used may be provided by a notch on the head or the tank which uses the special ink and the main unit may detect the ID to switch the heater to be driven, and the drive frequency, the predischarge condition and the PWM table may be switched in accordance with the switched heater. Further, when the ink is selected on the panel of the recording apparatus main unit or the screen of the personal computer, the heater to be driven and the drive frequency for the heater to be driven may be switched.

Fifth Embodiment

Figure 13:
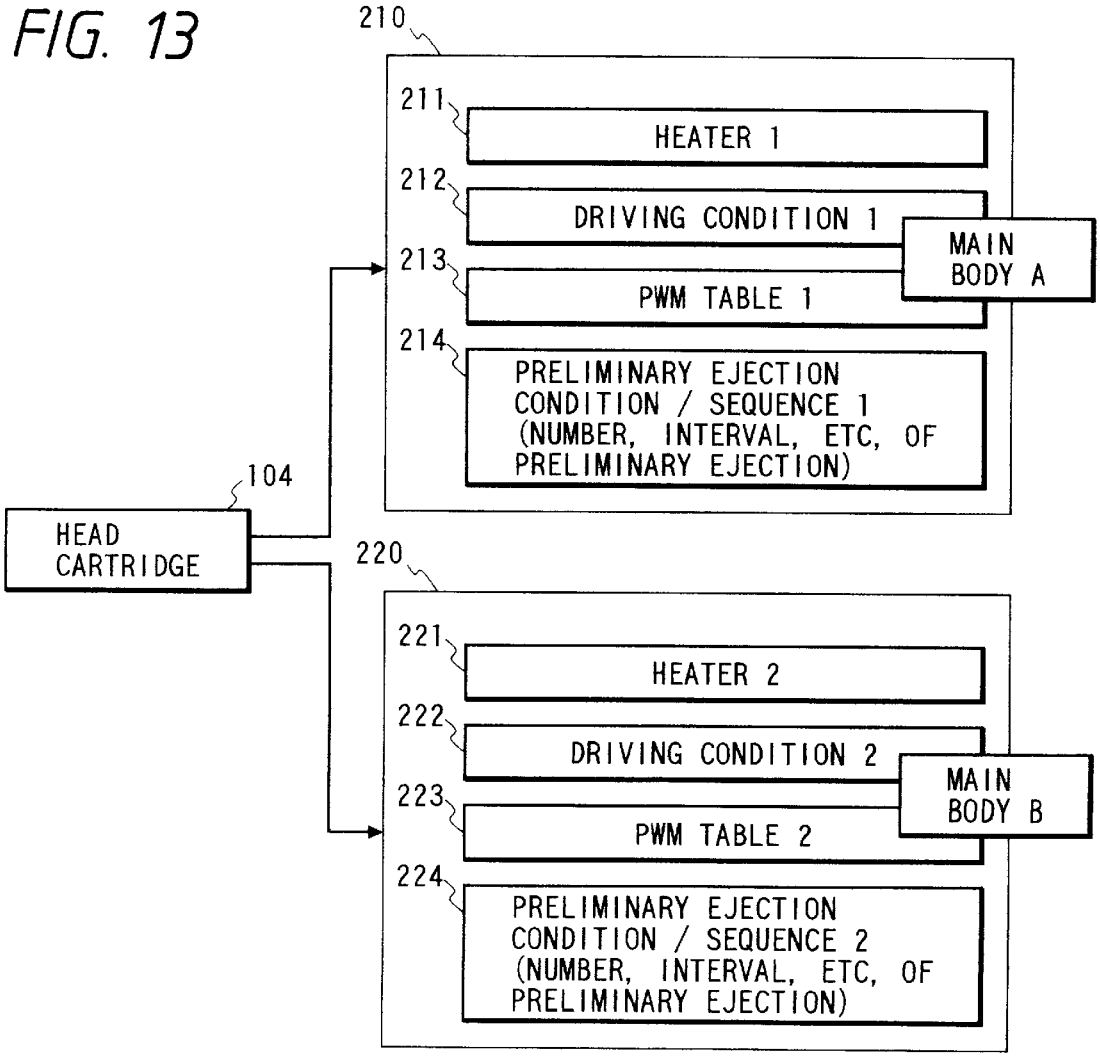
FIG. 13 shows a block diagram of a fifth embodiment of the present invention.

FIG. 13 shows a block diagram of a fifth embodiment of the ink jet recording apparatus of the present invention.

In the present embodiment, when the printing is made by the small dots, the heater to be driven is switched by the type of the recording apparatus main unit in which the head is used. In other words, the heater to be driven is defined in accordance with the apparatus. A product which is small in the main unit and inexpensive in cost even though the printing speed is somewhat low may be required in a certain form of product. Namely, the head 104 remains unchanged but the type of the recording apparatus main unit may be changed. A main unit A has control means 210 and the control means 210 includes means 211 for driving a heater 1. A main unit B has control means 220 and the control means 220 includes means 221 for driving a heater 2.

By lowering the moving speed of the carriage for mounting the head and making the carriage smaller, a torque of the motor for driving the carriage may be reduced. Thus, the cost of the motor is reduced and the power supply capacity may be small and the power supply is inexpensive. In this case, only the front heater 1 having the low discharge drive frequency is used in the main unit A.

On the other hand, in the main unit B, the rear heater 2 having the high discharge drive frequency is selected when the high printing speed is more important even though the precision of the impact point and the discharge reliability are somewhat lower.

Other Embodiments

In the present embodiment, a circuit of the element board for efficiently driving the electro-thermal transducer elements by the head in which a plurality of electro-thermal transducer elements are arranged in each nozzle and attain the compact element board is explained. The term "on the board" used in the present embodiment is used to include the inside near the surface of the board.

Figure 14:
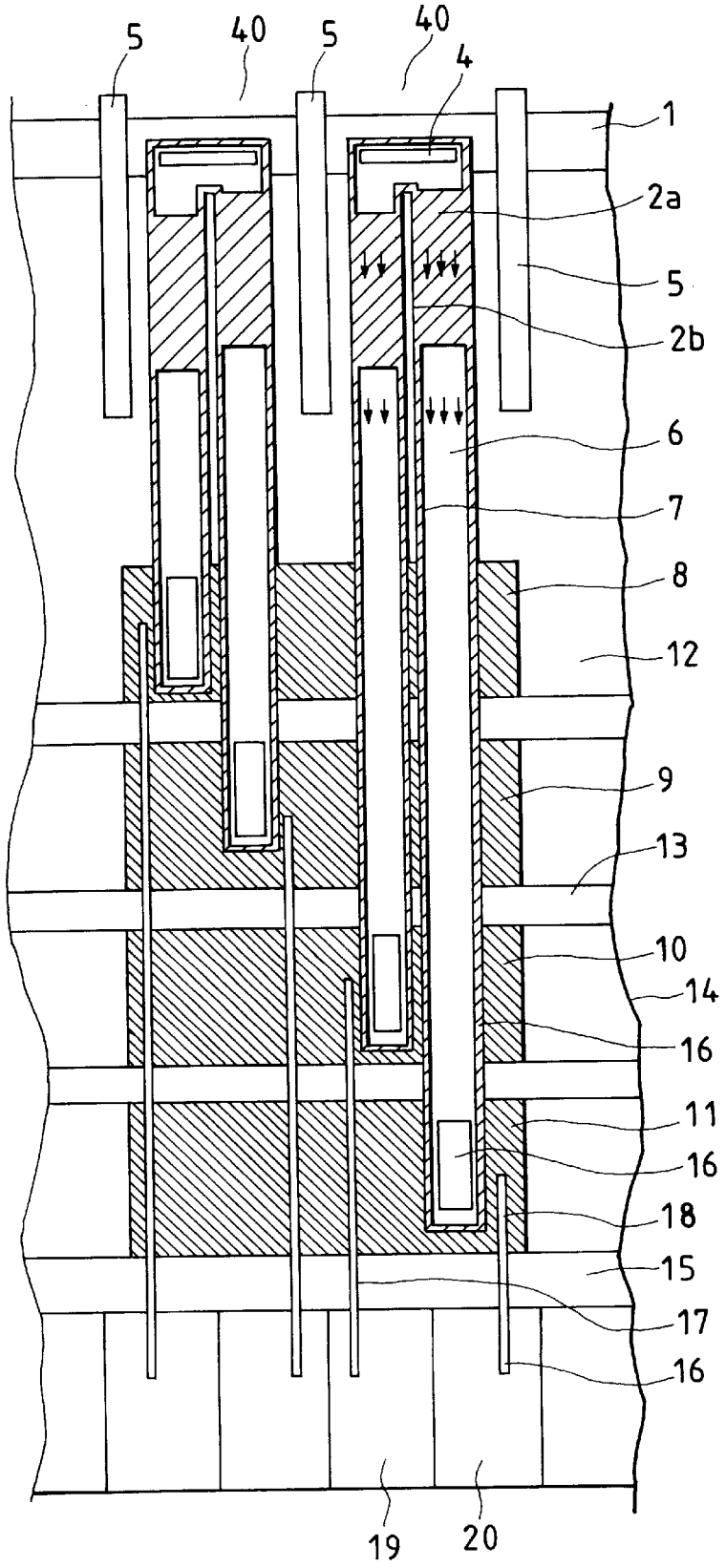
FIG. 14 shows a plan view of arrangement of elements of an element board in other embodiment.

FIG. 14 shows an arrangement of the elements of the element board in accordance with the present embodiment. Nozzle walls 5 are provided on the element board, and two discharge heaters, an electro-thermal transducer element (hereinafter referred to as "discharge heater") 2*a* and a discharge heater 2*b* are arranged in each discharge nozzle between nozzle walls 5, in the same condition as that described in the first embodiment. The respective discharge heaters are connected to the common wiring 1 under the interlayer insulation films of the lower layers of the discharge heaters through through-holes 4, and voltages are applied through the common wiring 1. Wirings 6 and 7 connect the discharge heaters 2*a* and 2*b* to switching transistors 11 and 10, respectively, through a through-hole 16.

Figure 15:
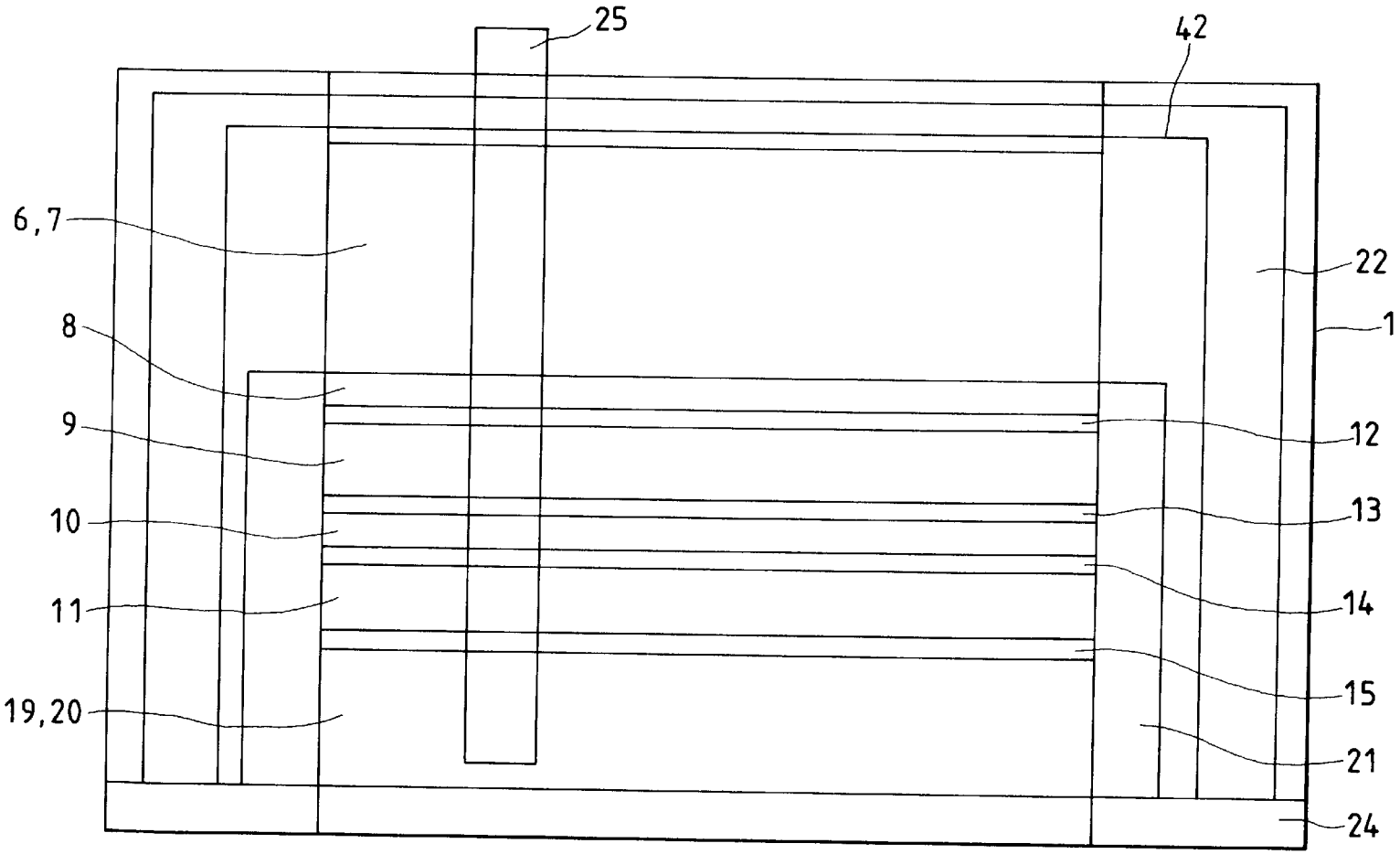
FIG. 15 shows an overall arrangement the element board in other embodiment.
Figure 16:
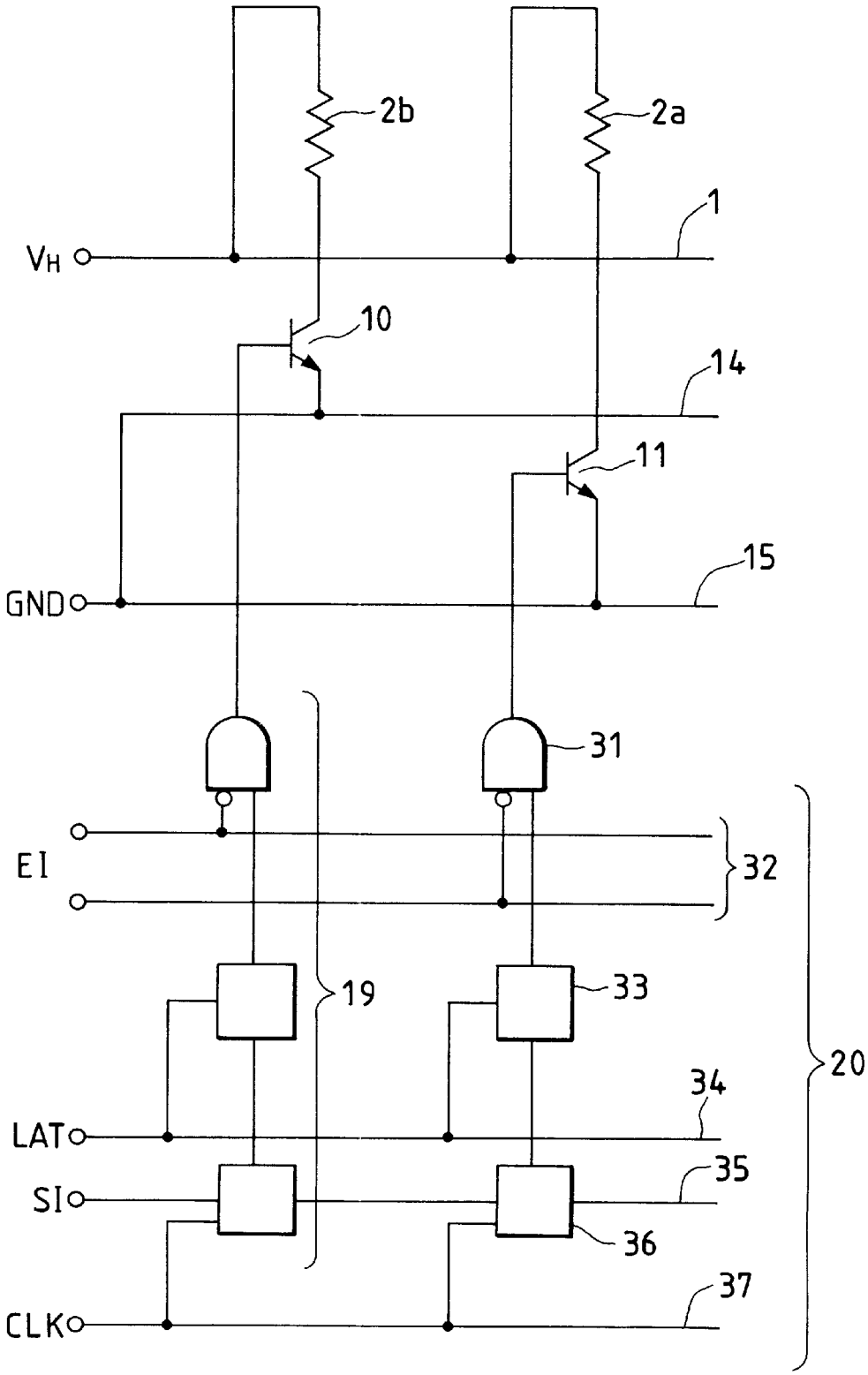
FIG. 16 shows an equivalent circuit of the element board shown in FIG. 14.
Figure 17:
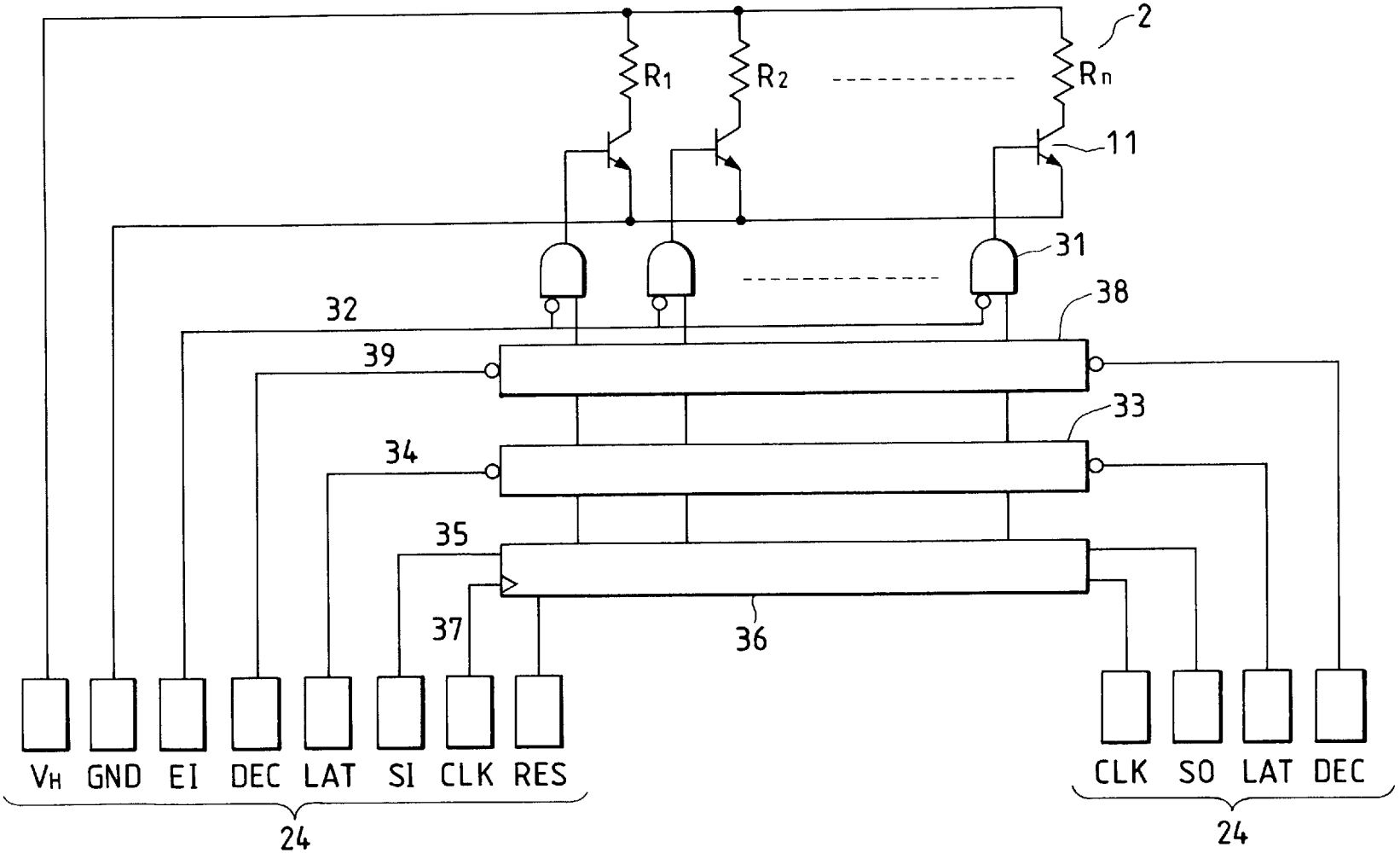
FIG. 17 shows an equivalent circuit of the overall configuration of the element board shown in FIG. 15.
Figure 18:
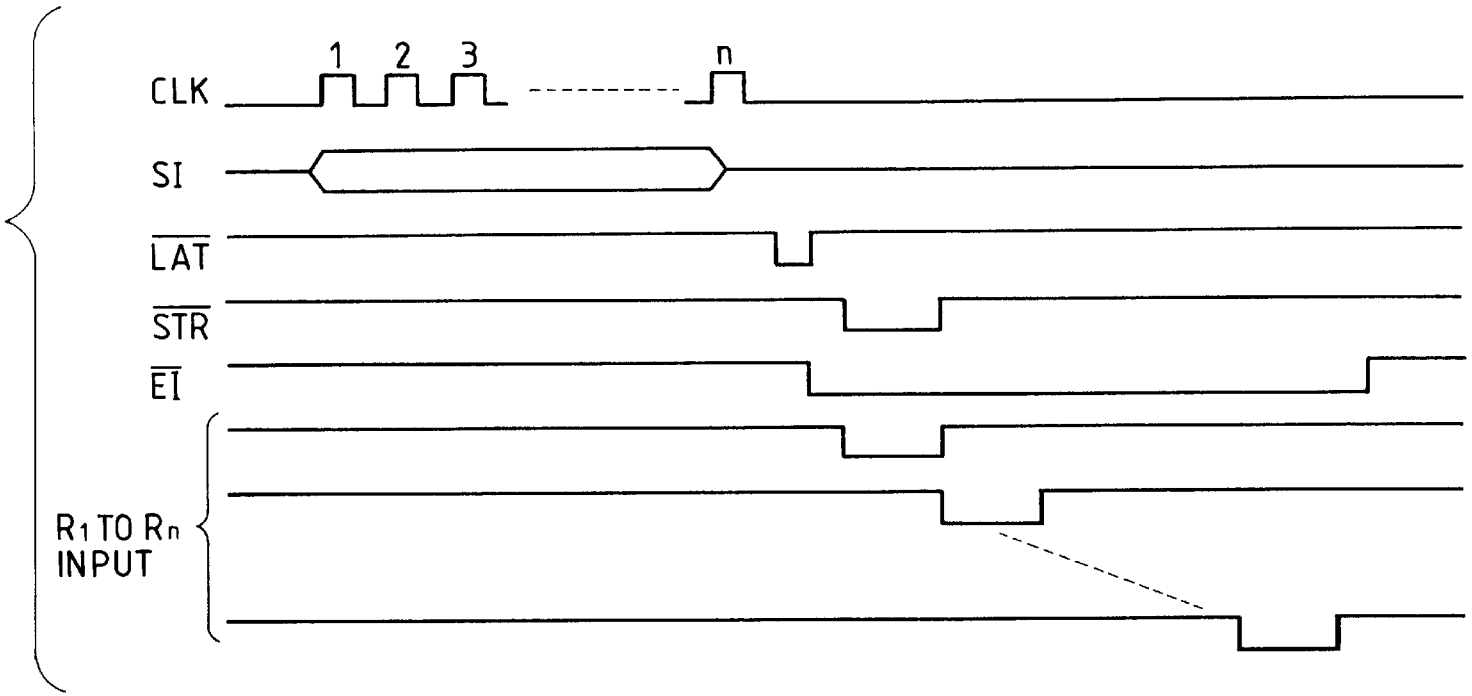
FIG. 18 shows a basic timing chart in the equivalent circuit of the element board shown in FIG. 17.

The switching transistors 10 and 11 are also arranged under the interlayer insulation films of the heater lower layers. Signal wirings 17 and 18 are connected to the transistors 10 and 11 and shift register latch circuits 19 and 20 to control the turn on/off of the transistors 10 and 11. Thus, the drive of the heater is limited by turning on and off the transistors by the data latched in the shift register latch circuit. The ground wirings 12, 13, 14 and 15 are connected to emitters of the switching transistors 8, 9, 10 and 11, respectively. FIG. 14 shows the configuration of two nozzles and FIG. 15 shows an arrangement of the overall board. In FIG. 15, the element board 1 comprises continuous arrangement of cells 25 of one-turn construction. A common wiring 42 is connected to a contact 24 by a common vertical wiring 22 and receives supply from an external power supply. Ground wirings 12, 13, 14 and 15 are connected to the contact 24 by a ground vertical wiring 21. Equivalent circuits of FIGS. 14 and 15 are shown in FIGS. 16 and 17, respectively. FIG. 16 shows detail of shift register latch circuits 19 and 20. A CLK signal line 37 and a serial data line 35 are inputted to a shift register 36, and the serial data is developed into the shift register 36 by a clock signal. The data inputted to the shift register 36 is held in a latch 33 by a latch signal from a latch signal line 34. An enable signal 32 is connected to an AND gate 31 which receives a timing signal to apply the data of the latch 33 to the transistor 11. Since two enable signals 32 are provided, the discharge heaters 2*a* and 2*b* may be driven either simultaneously or at different timings. FIG. 17 shows an equivalent circuit of an overall arrangement of the board having cells of FIG. 16 continuously arranged. A decoder circuit 38 and a decoder signal line 39 are provided to vary the drive timing so that the drive may be made at many timings with a small number of contacts and without two or more enable signals 32. FIG. 18 shows a basic timing chart thereof.

Figure 19:
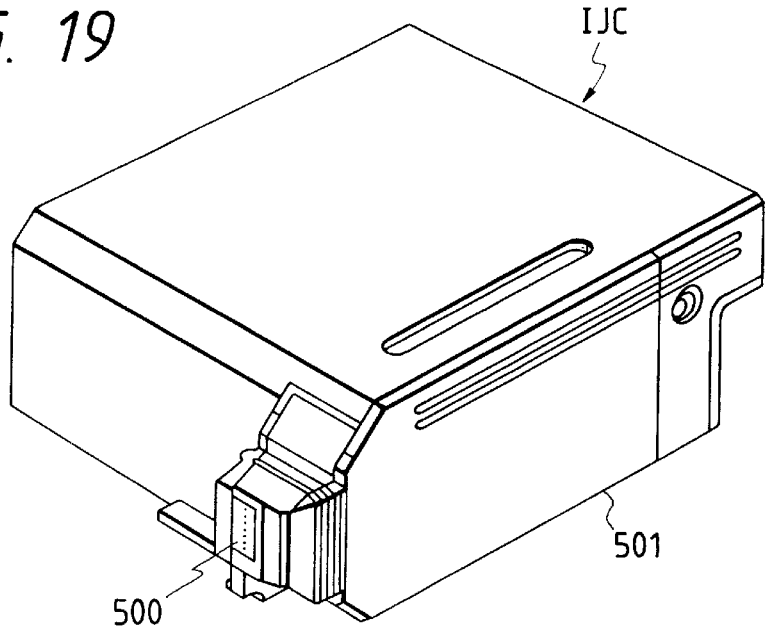
FIG. 19 shows a perspective view of an ink jet head cartridge having an ink jet head of the present invention and an ink container for holding ink to be supplied to the ink jet head separately connected.

FIG. 19 shows a perspective view of an ink jet head carriage IJC having an ink jet head 500 of the present invention and an ink container 501 for holding the ink to be supplied to the ink jet head 500 separably connected.

The injection of the ink to the ink container of the ink jet head cartridge may be conducted in the following manner.

An ink introduction path for introducing the ink is formed by connecting an ink supply pipe to the ink container and the ink may be injected to the ink container through the ink introduction path. A supply port to the ink jet head, a vent port and a hole formed in a wall of the ink container may be used as the ink supply port of the ink container.

Figure 20:
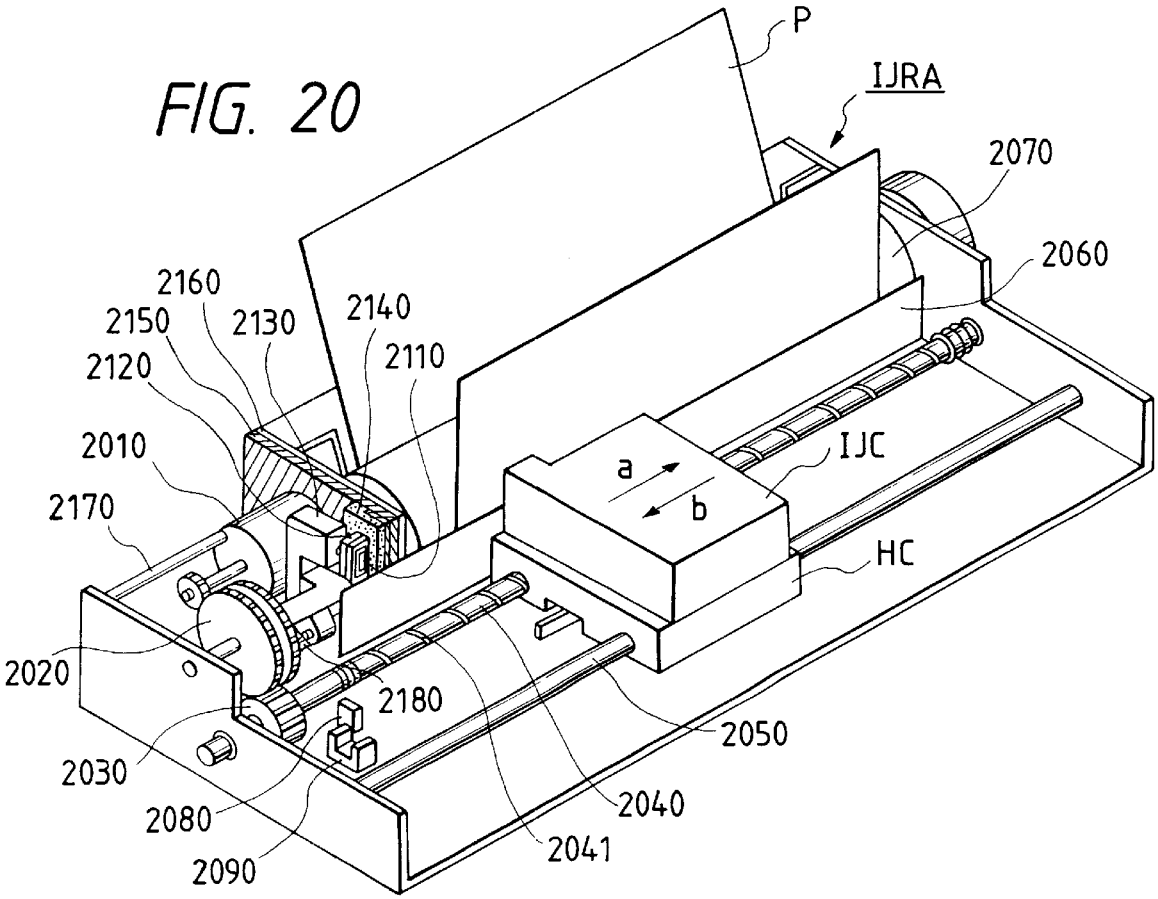
FIG. 20 shows a views of an ink jet recording apparatus in which the ink jet recording head of the present invention is to be mounted.

FIG. 20 shows a view of an ink jet recording apparatus in which the ink jet recording head constructed in the manner described above is mounted. The ink jet recording apparatus IJRA comprises a lead screw 2040 rotated through driving force transmission gears 2020 and 2030 which are linked to the forward and backward rotations of a drive motor 2010. A carriage HC on which the ink jet cartridge IJC having the ink jet recording head and the ink tank integrated is supported by a carriage shaft 2050 and the lead screw 2040 and has a pin (not shown) which engages with a spiral groove 2041 of the lead screw 2040 and is reciprocally driven in directions a and b as the lead screw 2040 is rotated. Numeral 2060 denotes a sheet retainer plate which presses a sheet P against a platen 2070 along the direction of the carriage movement. Numerals 2080 and 2090 denote photo-couplers which serve as home position detection means by sensing the presence of a lever 2100 provided on the carriage HC and switch the direction of rotation of the motor 2010. Numeral 2110 denotes a cap member for capping the front of the recording head and is supported by a support member 2120. Numeral 2130 denotes suction means fir sucking the inside of the cap and conducting the suck recovery of the recording head through the opening in the cap. A cleaning blade 2140 for cleaning the end of the recording head is provided on a member 2150 which is movable forwardly and backwardly, and they are supported by a main unit support plate 2160. The blade 2140 is not limited to the form illustrated but any known cleaning blade may be applied to the present embodiment. Numeral 2170 denotes a lever to start the suction of the suction recovery and it is moved as a cam 2180 which engates with the carriage HC is moved so that the drive force from the drive motor 2010 is controlled by the known transmission means such as the swishing by a clutch.

The capping, the cleaning and the suction recovery are conducted at the corresponding positions by the action of the lead screw 2040 when the carriage HC reaches the home position area, and the any may be applied to the present embodiment by conducting the desired process at known timing. Each constriction described above are excellent invention when viewed either singly or in combination and shows preferred construction for the present invention.

While the Embodiments 3 to 5 are described as the ink jet recording apparatus, all means may be provided in the head.

In accordance with the present invention, since by discharge characteristic in which the discharge rate increases as the position of the electro-thermal transducer element is closer to the orifice and the refill frequency decrease as the position of the electro-thermal transducer element is closer to the orifice as opposed to the discharge rate by switching the electro-thermal transducer element to be driven is fully utilized, the discharge may be arranged at the optimum discharge condition for the respective information.

Particularly, by selecting the front heater in the switching of the electro-thermal transducer element to be driven, the discharge with the high discharge power (dischage rate) which improves the precision of the impact point and the discharge reliability is attained even though the print speed is somewhat low is attained, and by selecting the rear heater, the discharge with the high drive frequency which improves the print speed even though the precision of the impact point and the discharge reliability are somewhat low is attained so that the discharge (recording) may be conducted at the optimum condition for the purpose of usage of the head or the use condition.

What is claimed is:

1. An ink discharge method comprising the steps of:

preparing an ink jet recording head comprising an orifice for discharging ink, an ink flow path connected to said orifice and a plurality of electro-thermal transducer elements arranged at different locations on a same plane in the ink flow path for generating thermal energy, said recording head discharging the ink by applying the thermal energy to the ink in the ink flow path by driving the electro-thermal transducer elements, said electro-thermal transducer elements including two electro-thermal transducer elements having different distances between a center of gravity of the electro-thermal transducer element and the orifice, each of said two transducer elements being capable of generating thermal energy to discharge the ink; and discharging the ink by alternately driving said two electro-thermal transducer elements, whereby the ink is discharged when either of said transducer elements generates thermal energy.

2. An ink discharge method according to claim 1 wherein said discharging step includes a first mode for discharging large ink droplets and a second mode for discharging small ink droplets, and in said second mode, said two electro-thermal transducer elements are alternately used to discharge the ink.

3. An ink discharge method according to claim 2 wherein in said first mode of said discharging step, said two electro-thermal transducer elements are simultaneously used to discharge the ink.

4. An ink discharge method according to claim 3, wherein immediately after the shift from the first mode to the second mode in said discharging step, one of the two electro-thermal transducer elements a center of gravity of which is farther from the orifice is first driven.

5. An ink discharge method according to claim 1 wherein the discharge amounts of inks when said two electro-thermal transducer elements are independently driven, are substantially equal.

6. An ink discharge method according to claim 5 wherein centers of gravity of said two electro-thermal transducer elements are arranged in an area in which the discharge amount of the ink increases as a distance from the orifice to the center of gravity thereof decreases, and an area in which the discharge amount of the ink increases, respectively.

7. An ink discharge method according to claim 1 wherein one of said two electro-thermal transducer elements a center of gravity of which is closer to the orifice is first driven in said discharging step.

8. A method according to claim 1, wherein said step of preparing an ink jet recording head includes the step of providing said electro-thermal transducer elements such that they are arranged partially side by side at different locations along said ink flow path.

9. An ink jet recording apparatus comprising:

an ink jet recording head comprising an orifice for discharging ink, an ink flow path connected to said orifice and a plurality of electro-thermal transducer elements arranged at different locations on a same plane in the ink flow path for generating thermal energy, said recording head discharging the ink by applying the thermal energy to the ink in the ink flow path by driving the electro-thermal transducer elements, said electro-thermal transducer elements including two electro-thermal transducer elements having different distances between a center of gravity of the electro-thermal transducer element and the orifice, each of said two transducer elements being capable of generating thermal energy to discharge the ink; and drive control means for alternately driving said two electro-thermal transducer elements, whereby the ink is discharged when either of said transducer elements generates thermal energy.

10. An ink jet recording apparatus according to claim 9 wherein said drive control means includes a first mode for discharging large ink droplets and a second mode for discharging small ink droplets, and in the second mode, said two electro-thermal transducer elements are alternately driven.

11. An ink jet recording apparatus according to claim 9, wherein said electro-thermal transducer elements are arranged partially side by side at different locations along said ink flow path.

12. An ink jet recording apparatus comprising an ink jet recording head comprising an orifice for discharging ink, an ink flow path connected to said orifice and a plurality of electro-thermal transducer elements arranged at different locations on a same plane in the ink flow path for generating thermal energy, said recording head discharging the ink by applying the thermal energy to the ink in the ink flow path by driving the electro-thermal transducer elements, said plurality of electro-thermal transducer elements including two electro-thermal transducer elements having different distances between a center of gravity of the electro-thermal transducer element and the orifice, each of said two transducer elements being capable of generating thermal energy to discharge the ink; and said two electro-thermal transducer elements being alternately driven, whereby the ink is discharged when either of said transducer elements generates thermal energy.

13. An ink jet recording head according to claim 12 wherein said ink jet recording head has a first mode for discharging large ink droplets and a second mode for driving small ink droplets, and in the second mode, said two electro-thermal transducer elements are alternately driven.

14. An ink jet recording apparatus according to claim 12, wherein said electro-thermal transducer elements are arranged partially side by side at different locations along said ink flow path.

15. An ink jet recording head comprising;

a plurality of electro-thermal transducer elements arranged at different locations on a same plane in an ink flow path connected to an orifice of ink, two of said electro-thermal transducer elements being arranged with different distances from the orifice to the electro-thermal transducer element, said two electro-thermal transducer elements each being capable of generating thermal energy to discharge ink and each of said transducer elements having substantially the same discharge amount of droplets when driven independently; and means for switching the electro-thermal transducer element to be driven in accordance with various information, whereby the ink is discharged when either of said transducer elements generates thermal energy.

16. An ink jet recording head according claim 15 wherein said switching means switches the electro-thermal transducer element to be driven in accordance with a temperature of a head main unit.

17. An ink jet recording head according to claim 16 wherein said switching means drives the electro-thermal transducer element closer to the orifice when the temperature of the head main unit is low or the humidity of the head main unit is low.

18. An ink jet recording head according to claim 15 wherein said switching means switches the electro-thermal transducer element to be driven in accordance with a print mode.

19. An ink jet recording head according to claim 18 wherein said print mode includes a large discharge amount mode for driving both of said two electro-thermal transducer elements and a small discharge amount mode for driving one of the electro-thermal transducer elements.

20. An ink jet recording head according to claim 19 wherein regarding said small discharge amount mode, said switching means drives the electro-thermal transducer element closer to the orifice in a discharge reliability priority mode or an image precision priority mode and drives the electro-thermal transducer element farther from the orifice in a high speed print mode.

21. An ink jet recording head according to claim 15 wherein said switching means switches the electro-thermal transducer element to be driven in accordance with a type of recording liquid.

22. An ink jet recooking head according to claim 21 wherein said switching means drives the electro-thermal transducer element closer to the orifice when the recording liquid is ink of a type which is more easily dried than normal ink.

23. An ink jet recording head according to claim 15 wherein said switching means switches the electro-thermal transducer element to be driven in accordance with a type of recording apparatus main unit.

24. An ink jet recording head according to claim 23 wherein said switching means drives the electro-thermal transducer element closer to the orifice when the recording apparatus is of a type having smaller drive means than a size of drive means of a normal head scan.

25. An ink jet recording head according to claim 15 wherein said switching means changes the drive frequency of the electro-thermal transducer element in accordance with the switching of the electro-thermal transducer element.

26. An ink jet recording head according to claim 25 wherein said switching means changes a condition of pre-discharge in accordance with the switching of the electro-thermal transducer element.

27. An ink jet recording head according to claim 26 wherein said switching means changes a PWM table in accordance with the switching of the electro-thermal transducer element.

28. An ink jet recording head according to claim 27 wherein said switching means changes a discharge timing in accordance with the switching of the electro-thermal transducer element.

29. An ink jet recording head according to claim 15, wherein said electro-thermal transducer elements are arranged partially side by side at different locations along said ink flow path.

30. An ink jet recording apparatus comprising:

a recording head having a plurality of electro-thermal transducer elements arranged at different locations on a same plane in an ink flow path connected to an orifice of ink, two of said electro-thermal transducer elements being arranged with different distances from the orifice to the electro-thermal transducer element, said two electro-thermal transducer elements each being capable of generating thermal energy to discharge ink and each of said transducer elements having substantially the same discharge amount of droplets when driven independently; and means for switching the electro-thermal transducer element to be driven in accordance with various information, whereby the ink is discharged when either of said transducer elements generates thermal energy.

31. An ink jet recording apparatus according to claim 30 wherein said switching means switches the electro-thermal transducer element to be driven in accordance with a temperature of a head main unit.

32. An ink jet recording apparatus according to claim 31 wherein said switching means drives the electro-thermal transducer element closer to the orifice when the temperature of the head main unit is low or the humidity of the head main unit is low.

33. An ink jet recording apparatus according to claim 30 wherein said switching means switches the electro-thermal transducer element to be driven in accordance with a print mode.

34. An ink jet recording apparatus according to claim 33 wherein said print mode includes a large discharge amount mode for driving both of said two electro-thermal transducer elements and a small discharge amount mode for driving one of the electro-thermal transducer elements.

35. An ink jet recording apparatus according to claim 34 wherein regarding said small discharge amount mode, said switching means drives the electro-thermal transducer element closer to the orifice in a discharge reliability priority mode or an image precision priority mode and drives the electro-thermal transducer element farther from the orifice in a high speed print mode.

36. An ink jet recording apparatus according to claim 30 wherein said switching means switches the electro-thermal transducer element to be driven in accordance with a type of recording liquid.

37. An ink jet recording apparatus according to claim 36 wherein said switching means drives the electro-thermal transducer element closer to the orifice when the recording liquid is ink of a type which is more easily dried than normal ink.

38. An ink jet recording apparatus according to claim 30 wherein said switching means switches the electro-thermal transducer element to be driven in accordance with a type of recording apparatus main unit.

39. An ink jet recording apparatus according to claim 38 wherein said switching means drives the electro-thermal transducer element closer to the orifice when the recording apparatus is of a type having smaller drive means than a size of drive means of a normal head scan.

40. An ink jet recording apparatus according to claim 30 wherein said switching means changes the drive frequency of the electro-thermal transducer element in accordance with the switching of the electro-thermal transducer element.

41. An ink jet recording apparatus according to claim 40 wherein said switching means changes a condition of pre-discharge in accordance with the switching of the electro-thermal transducer element.

42. An ink jet recording apparatus according to claim 41 wherein said switching means changes a PWM table in accordance with the switching of the electro-thermal transducer element.

43. An ink jet recording apparatus according to claim 42 wherein said switching means changes a discharge timing in accordance with the switching of the electro-thermal transducer element.

44. An ink jet recording apparatus according to claim 30, wherein said electro-thermal transducer elements are arranged partially side by side at different locations along said ink flow path.

45. An ink jet recording method comprising the steps of:

preparing a recording head having a plurality of electro-thermal transducer elements arranged at different locations on a same plane in an ink flow path connected to an orifice of ink, two of said electro-thermal transducer elements being arranged with different distances from the orifice to the electro-thermal transducer element, said two electro-thermal transducer elements each being capable of generating thermal energy to discharge ink and each of said transducer elements having substantially the same discharge amount of droplets when driven independently; and means for switching the electro-thermal transducer element to be driven in accordance with various information, whereby the ink is discharged when either of said transducer elements generates thermal energy.

46. An ink jet recording method according to claim 45 wherein said switching step switches the electro-thermal transducer element to be driven in accordance with a temperature of a head main unit.

47. An ink jet recording method according to claim 46 wherein said switching step drives the electro-thermal transducer element closer to the orifice when the temperature of the head main unit is low or the humidity of the head main unit is low.

48. An ink jet recording method according to claim 45 wherein said switching step switches the electro-thermal transducer element to be driven in accordance with a print mode.

49. An ink jet recording method according to claim 48 wherein said print mode includes a large discharge amount mode for driving both of said two electro-thermal transducer elements and a small discharge amount mode for driving one of the electro-thermal transducer elements.

50. An ink jet recording method according to claim 49 wherein regarding said small discharge amount mode, said switching step drives the electro-thermal transducer element closer to the orifice in a discharge reliability priority mode or an image precision priority mode and drives the electro-thermal transducer element farther from the orifice in a high speed print mode.

51. An ink jet recording method according to claim 45 wherein said switching step switches the electro-thermal transducer element to be driven in accordance with a type of recording liquid.

52. An ink jet recording method according to claim 51 wherein said switching step drives the electro-thermal transducer element closer to the orifice when the recording liquid is ink of a type which is more easily dried than normal ink.

53. An ink jet recording method according to claim 45 wherein said switching step switches the electro-thermal transducer element to be driven in accordance with a type of recording apparatus main unit.

54. An ink jet recording method according to claim 53 wherein said switching step drives the electro-thermal transducer element closer to the orifice when the recording apparatus is of a type having smaller drive means than a size of drive means of a normal head scan.

55. An ink jet recording method according to claim 45 wherein said switching step changes the drive frequency of the electro-thermal transducer element in accordance with the switching of the electro-thermal transducer element.

56. An ink jet recording method according to claim 55 wherein said switching step changes a condition of predischarge in accordance with the switching of the electro-thermal transducer element.

57. An ink jet recording method according to claim 56 wherein said switching step changes a PWM table in accordance with the switching of the electro-thermal transducer element.

58. An ink jet recording method according to claim 57 wherein said switching step changes a discharge timing in accordance with the switching of the electro-thermal transducer element.

59. An ink jet recording method according to claim 45, said step of preparing a recording head includes the step of providing said electro-thermal transducer elements such that they are arranged partially side by side at different locations along said ink flow path.

* * * * *

UNITED STATES PATENT AND TRADEMARK OFFICE

CERTIFICATE OF CORRECTION

PATENT NO. : 6,169,556 B1
DATED : January 2, 2001
INVENTOR(S) : Noribumi Koitabashi et al.

It is certified that error appears in the above-identified patent and that said Letters Patent is hereby corrected as shown below:

Title page,
Item [56], References Cited, U.S. PATENT DOCUMENTS,
"4,847,358 * 7/1989 Moriyama" should read
-- 4,847,638 * 7/1989 Moriyama --; and Under FOREIGN PATENT DOCUMENTS "0707964A2 4/1996 (EP)" should read
-- 0707964A2 4/1995 (EP) --; and
"2169855A 7/1996 (GR)" should read
-- 2169855A 7/1986 (GR) --.

Column 5,
Line 32, "other" should read -- another --;
Line 34, "other" should read -- another --;
Line 46, "views" should read -- view --;
Line 63, "heaters which are" should read -- heaters on which --; and
Line 64, "arranged" (first occurrence) should read -- are located, --.

Column 9,
Line 55, "driven" should read -- be driven --.

UNITED STATES PATENT AND TRADEMARK OFFICE

CERTIFICATE OF CORRECTION

PATENT NO. : 6,169,556 B1
DATED : January 2, 2001
INVENTOR(S) : Noribumi Koitabashi et al.

It is certified that error appears in the above-identified patent and that said Letters Patent is hereby corrected as shown below:

Column 14,
Line 54, "fir" should read -- for --.

Column 15,
Line 4, "the any" should read -- they --; and
Line 6, "are" should read -- is an --.

Signed and Sealed this

Twenty-fifth Day of December, 2001

*Attest:*

*Attesting Officer*

JAMES E. ROGAN
*Director of the United States Patent and Trademark Office*